US006105367A

United States Patent [19]

Tsuruga et al.

[11] Patent Number: 6,105,367

[45] Date of Patent: Aug. 22, 2000

[54] HYDRAULIC DRIVE SYSTEM

[75] Inventors: Yasutaka Tsuruga, Ryugasaki; Takashi Kanai, Kashiwa; Junya Kawamoto, Tsuchiura, all of Japan

[73] Assignee: Hitachi Construction Machinery Co. Ltd., Tokyo, Japan

[21] Appl. No.: 09/077,468

[22] PCT Filed: Nov. 14, 1997

[86] PCT No.: PCT/JP97/04153

§ 371 Date: May 29, 1998

§ 102(e) Date: May 29, 1998

[87] PCT Pub. No.: WO98/22716

PCT Pub. Date: May 28, 1998

[30] Foreign Application Priority Data

Nov. 15, 1996 [JP] Japan ..... 8-304742

[51] Int. Cl.[7] ..... F16D 31/02

[52] U.S. Cl. ..... 60/422; 60/445; 60/447; 60/449; 60/452

[58] Field of Search ..... 60/449, 452, 422, 60/447, 445

[56] References Cited

U.S. PATENT DOCUMENTS 4,617,854 10/1986 Kropp .
5,285,642 2/1994 Watanabe et al. ..... 60/449

FOREIGN PATENT DOCUMENTS 27 54 430 6/1979 Germany .
3321483 12/1984 Germany .
60-11706 1/1985 Japan .
4-136509 5/1992 Japan .
4-258508 9/1992 Japan .
4-119604 10/1992 Japan .
5-33775 2/1993 Japan .
5-33776 2/1993 Japan .
5-99126 4/1993 Japan .
6-221305 8/1994 Japan .
2-526440 11/1996 Japan .
2592561 12/1996 Japan .
1 599 233 9/1981 United Kingdom .
WO92/06306 4/1992 WIPO .

*Primary Examiner*—Edward K. Look
*Assistant Examiner*—Hermes Rodriguez
*Attorney, Agent, or Firm*—Mattingly, Stanger & Malur, P.C.

[57] ABSTRACT

A hydraulic drive system wherein differential pressures across flow control valves are controlled by pressure compensating valves to become the same value, i.e., a differential pressure ΔPLS, and the differential pressure ΔPLS is maintained at a target differential pressure ΔPLSref by a pump displacement control system. For modifying the target differential pressure ΔPLSref depending on change in rotational speed of an engine, a flow rate detecting valve is disposed intermediate between delivery lines of a fixed displacement hydraulic pump and a differential pressure ΔPp across a variable throttle of the flow rate detecting valve is introduced to a setting modifying unit to thereby modify the target differential pressure ΔPLSref. The flow rate detecting valve changes an opening area of the variable throttle depending on the differential pressure ΔPp depending on the rotational speed of the engine.

7 Claims, 13 Drawing Sheets

HYDRAULIC DRIVE SYSTEM

TECHNICAL FIELD

The present invention relates to a hydraulic drive system including a variable displacement hydraulic pump, and more particularly to a hydraulic drive system operating under load sensing control to control the displacement of the hydraulic pump so that a differential pressure between a delivery pressure of the hydraulic pump and a maximum load pressure among a plurality of actuators is maintained at a setting value.

BACKGROUND ART

As to the load sensing control technique for controlling the displacement of a hydraulic pump so that a differential pressure between a delivery pressure of the hydraulic pump and a maximum load pressure among a plurality of actuators is maintained at a setting value, there are known a pump displacement control system disclosed in JP, A, 5-99126 and a hydraulic drive system disclosed in JP, A, 60-11706.

The pump displacement control system disclosed in JP, A, 5-99126 comprises a servo piston for tilting a swash plate of a variable displacement hydraulic pump, and a tilting control unit for supplying a pump delivery pressure to the servo piston in accordance with a differential pressure ΔPLS between a delivery pressure Ps of the hydraulic pump and a load pressure PLS of an actuator driven by the hydraulic pump so as to maintain the differential pressure ΔPLS at a setting value ΔPLSref, thereby controlling the pump displacement. The disclosed pump displacement control system further comprises a fixed displacement hydraulic pump driven by an engine along with the variable displacement hydraulic pump, a throttle disposed in a delivery line of the fixed displacement hydraulic pump, and setting modifying means for modifying the setting value ΔPLSref of the tilting control unit in accordance with a differential pressure ΔPp across the throttle. The setting value ΔPLSref of the tilting control unit is modified by detecting an engine rotational speed based on change in the differential pressure across the throttle disposed in the delivery line of the fixed displacement hydraulic pump.

The hydraulic drive system disclosed in JP, A, 60-11706 comprises a variable displacement hydraulic pump, a plurality of actuators driven by a hydraulic fluid delivered from the hydraulic pump, a plurality of flow control valves for controlling flow rates of the hydraulic fluid supplied from the hydraulic pump to the plurality of actuators, a plurality of pressure compensating valves controlling differential pressures across the plurality of flow control valves to become equal to each other, and a pump displacement control unit for controlling the displacement of the hydraulic pump so that a differential pressure ΔPLS between a delivery pressure Ps of the hydraulic pump and a maximum load pressure PLS among the plurality of actuators is maintained at a setting value ΔPLSref. The pressure compensating valves are installed upstream of the flow control valves, respectively. Each pressure compensating valve is arranged to receive the differential pressure across the flow control valve acting in the valve-closing direction and the differential pressure ΔPLS between the delivery pressure Ps of the hydraulic pump and the maximum load pressure PLS among the plurality of actuators in the valve-opening direction, for thereby controlling the differential pressure across the flow control valve with the differential pressure ΔPLS as a target differential pressure for pressure compensation. As a result, the differential pressures across the plurality of flow control valves are controlled to become equal to each other.

DISCLOSURE OF THE INVENTION

Consider, as a comparative example, a system in which the pump displacement control system disclosed in JP, A, 5-99126 is used as a pump displacement control system for the hydraulic drive system disclosed in JP, A, 60-11706. In such a system, the target differential pressure across the flow control valve controlled by the pressure compensating valve is coincident with the setting value ΔPLSref of the differential pressure ΔPLS between the delivery pressure Ps of the hydraulic pump controlled by the pump displacement control means and the maximum load pressure PLS. The setting value ΔPLSref in the tilting control unit is therefore controlled in proportion to the engine rotational speed, and so is the target differential pressure (=ΔPLSref) across the flow control valve. In this case, setting is usually made such that a flow rate demanded by each of the actuators in the sole operation thereof does not exceed a maximum delivery rate of the hydraulic pump. As a result, in the sole operation of any one of the actuators, the hydraulic fluid is supplied to each actuator at a flow rate proportional to the amount of stroke by which the flow control valve is shifted, regardless of the engine rotational speed, thus ensuring good operability.

On the other hand, when the maximum delivery rate of the hydraulic pump does not reach a flow rate demanded by all of the flow control valves in, e.g., the combined operation during which a plurality of actuators are driven simultaneously, there occurs a condition where the flow rate supplied to the actuators is insufficient (referred to as saturation hereinafter). Further, in the combined operation, if the engine rotational speed is set lower than the speed in ordinary work, the flow rate demanded by all of the flow control valves also lowers in proportion to the engine rotational speed because the target differential pressure ΔPLSref across each flow control valve is reduced in proportion to the engine rotational speed by the cooperation of the above-mentioned two conventional systems even in a combination of the same shift strokes of the flow control valves. However, since the maximum delivery rate of the hydraulic pump is also reduced in proportion to the engine rotational speed, a shortage of the flow rate occurs at the same proportion (see FIG. 4). Accordingly, when the shift stroke of the flow control valve enters the saturation region, the operation of the actuator in proportion to the shift stroke is no longer ensured, making an operator feel awkward. In practice, since excavation work carried out at the ordinary engine rotational speed requires response rather than operability in fine operation, the saturation phenomenon does not lead to a considerable problem. However, when the engine rotational speed is lowered for the purpose of carrying out fine operation, saturation occurs depending on the amount of stroke by which the flow control valve is shifted, thus giving the operator an awkward feeling.

An object of the present invention is to provide a hydraulic drive system wherein good operability and fine operation can be obtained-when an engine rotational speed is set to a low value, by improving a saturation phenomenon in consideration of the engine rotational speed.

Features of the present invention to achieve the above object and other associated features are as follows.

(1) To begin with, according to the present invention, there is provided a hydraulic drive system comprising an engine, a variable displacement hydraulic pump driven by the engine, a plurality of actuators driven by a hydraulic fluid delivered from the hydraulic pump, a plurality of flow control valves for controlling flow rates of the hydraulic fluid supplied from the hydraulic pump to a plurality of actuators, and pump displacement control means for controlling the displacement of the hydraulic pump so that a differential pressure ΔPLS between a delivery pressure Ps of the hydraulic pump and a maximum load pressure PLS among the plurality of actuators is maintained at a setting value ΔPLSref, the pump displacement control means being able to modify the setting value ΔPLSref depending on a rotational speed of the engine, wherein the hydraulic drive system further comprises: a plurality of pressure compensating valves for controlling respective differential pressures across the plurality of flow control valves to the same value as the differential pressure ΔPLS, and setting modifying means for detecting the rotational speed of the engine and, when the detected engine rotational speed is in a region including the lowest rotational speed of the engine, for modifying the setting value ΔPLSref of the pump displacement control means so that a total maximum flow rate Qvtotal of the plurality of flow control valves having respective flow rates expressed by the products of the differential pressure ΔPLS and respective opening areas of the plurality of flow control valves is smaller than a maximum delivery rate Qsmax of the hydraulic pump corresponding to the engine rotational speed at that time.

By providing the setting modifying means to adjust the relationship between the total maximum demanded flow rate Qvtotal of the plurality of flow control valves and the maximum delivery rate Qsmax of the hydraulic pump, the total maximum demanded flow rate of the plurality of flow control valves is greater than the maximum delivery rate of the hydraulic pump and the system is under a condition giving rise to saturation when the engine rotational speed is set to the rated rotational speed suitable for ordinary work, but when the engine rotational speed is set to a low value, the total maximum demanded flow rate of the plurality of flow control valves is reduced to become smaller than the maximum delivery rate of the hydraulic pump and hence no saturation occurs. Accordingly, a change gradient of the flow rate passing through the plurality of flow control valves with respect to a total lever input amount applied to the flow control valves is so reduced as to ensure a wide metering effective area, and good operability can be realized by using the wide metering effective area.

(2) In the above (1), preferably, the setting modifying means comprises a fixed displacement hydraulic pump driven by the engine along with the variable displacement hydraulic pump, a flow rate detecting valve disposed in a delivery line of the fixed displacement hydraulic pump, and an operation driver for modifying the setting value ΔPLSref depending on a differential pressure ΔPp across the flow rate detecting valve, the flow rate detecting valve being constructed to have a larger opening area when the engine rotational speed is in the region including the rated rotational speed than when the engine rotational speed is in a region including the lowest rotational speed.

With that feature, the setting modifying means can realize the function of the above (1) (i.e., the function of detecting the rotational speed of the engine and, when the detected engine rotational speed is in the region including the lowest rotational speed of the engine, modifying the setting value ΔPLSref of the pump displacement control means so that the total maximum flow rate Qvtotal of the flow control valves is smaller than the maximum delivery rate Qsmax of the hydraulic pump) by using hydraulic arrangement.

(3) In the above (2), preferably, the flow rate detecting valve comprises a valve apparatus including a variable throttle, and throttle adjusting means for adjusting an opening area of the variable throttle to become smaller as the rotational speed of the engine lowers.

With that feature, the flow rate detecting valve is constructed to have a larger opening area when the engine rotational speed is in the region including the rated rotational speed than when it is in the region including the lowest rotational speed, as set forth in the above (2).

(4) In the above (2), alternatively, the flow rate detecting valve may comprise a valve apparatus including a fixed throttle, and throttle adjusting means for making the fixed throttle effective when the engine rotational speed is in the region including the lowest rotational speed, and controlling the fixed throttle to reduce an increase rate of the differential pressure across the flow rate detecting valve when the engine rotational speed rises to a certain setting rotational speed lower than the rated rotational speed.

With that feature, the flow rate detecting valve is also constructed to have a larger opening area when the engine rotational speed is in the region including the rated rotational speed than when it is in the region including the lowest rotational speed, as set forth in the above (2). In addition, the flow rate detecting valve is constructed by using a fixed throttle and therefore it can be manufactured more easily.

(5) In the above (3) or (4), preferably, the throttle adjusting means adjusts a position of the valve apparatus depending on the differential pressure ΔPp across the flow rate detecting valve itself.

With that feature, the flow rate detecting valve can detect the engine rotational speed in a hydraulic manner and adjust the opening area of the variable throttle or the throttling condition of the fixed throttle depending on the engine rotational speed.

(6) In the above (2), preferably, the setting modifying means further comprises a pressure control valve for generating a signal pressure corresponding to the differential pressure ΔPp across the flow rate detecting valve, the operation driver modifying the setting value ΔPLSref in accordance with a signal pressure from the pressure control valve.

With that feature, since the signal pressure can be introduced via a single pilot line, the circuit configuration is simplified. In addition, since the signal pressure is produced at a lower level, the pilot line can be formed of a hose or the like adapted for relatively low pressures, resulting in a reduced cost. (7) In the above (2), preferably, the pump displacement control means comprises a servo piston for operating a displacement varying mechanism of the variable displacement hydraulic pump, and a tilting control unit for driving the servo piston depending on the differential pressure ΔPLS between the delivery pressure Ps of the hydraulic pump and the load pressure PLS of the actuators, thereby maintaining the differential pressure ΔPLS at the setting value ΔPLSref, the tilting control unit including a spring for setting a basic value of the setting value ΔPLSref, the operation driver cooperating the spring to variably set the setting value ΔPLSref.

With that feature, the operation driver can modify the setting value ΔPLSref depending on the differential pressure across the flow rate detecting valve.

BEST MODE FOR CARRYING OUT THE INVENTION

Hereunder, embodiments of the present invention will be described with reference to the drawings.

Figure 1:
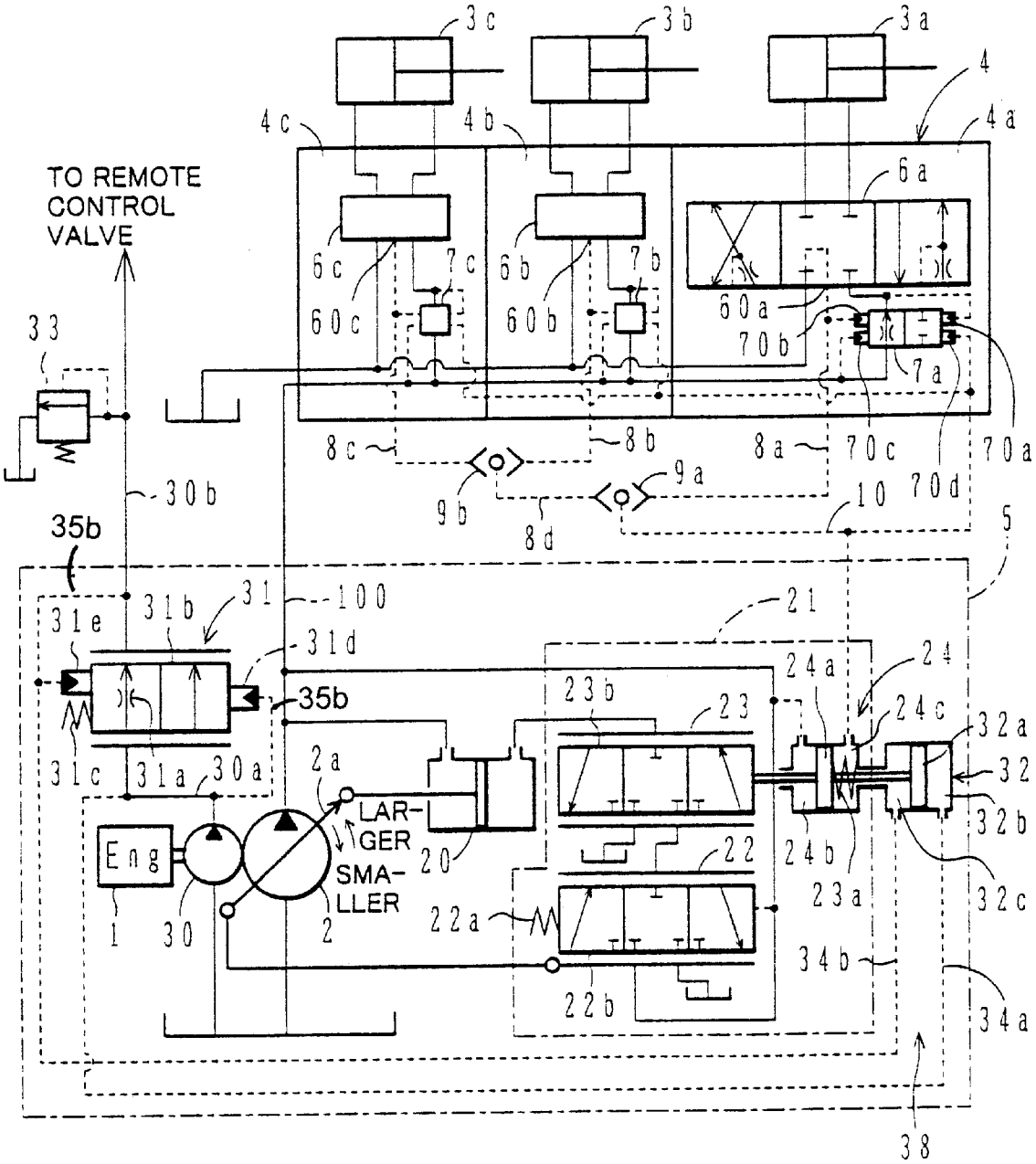
FIG. 1 is a hydraulic circuit diagram showing the configuration of a hydraulic drive system and a pump displacement control system according to a first embodiment of the present invention.

FIG. 1 shows a hydraulic drive system according to a first embodiment of the present invention. The hydraulic drive system comprises an engine 1, a variable displacement hydraulic pump 2 driven by the engine 1, a plurality of actuators 3*a*, 3*b*, 3*c* driven by a hydraulic fluid delivered from the hydraulic pump 2, a valve apparatus 4 including a plurality of directional control valves 4*a*, 4*b*, 4*c* connected to a delivery line 100 of the hydraulic pump 2 for controlling flow rates and directions at and in which the hydraulic fluid is supplied from the hydraulic pump 2 to the respective actuators 3*a*, 3*b*, 3*c*, and a pump displacement control system 5 for controlling the displacement of the hydraulic pump 2.

The plurality of directional control valves 4*a*, 4*b*, 4*c* are made up of respectively a plurality of flow control valves 6*a*, 6*b*, 6*c* and a plurality of pressure compensating valves 7*a*, 7*b*, 7*c* for controlling differential pressures across the plurality of flow control valves 6*a*, 6*b*, 6*c* to become equal to each other.

The plurality of pressure compensating valves 7*a*, 7*b*, 7*c* are of the pre-stage type installed upstream of the flow control valves 6*a*, 6*b*, 6*c*, respectively. The pressure compensating valve 7*a* has two pairs of opposing control pressure chambers 70*a*, 70*b*; 70*c*, 70*d*. Pressures upstream and downstream of the flow control valve 6*a* are introduced respectively to the control pressure chambers 70*a*, 70*b*, and a delivery pressure Ps of the hydraulic pump 2 and a maximum load pressure PLS among the plurality of actuators 3*a*, 3*b*, 3*c* are introduced respectively to the control pressure chambers 70*c*, 70*d*, whereby the differential pressure across the flow control valve 6*a* acts in the valve-closing direction and a differential pressure ΔPLS between the delivery pressure Ps of the hydraulic pump 2 and the maximum load pressure PLS among the plurality of actuators 3*a*, 3*b*, 3*c* acts in the valve-opening direction. Thus the pressure compensating valve 7*a* controls the differential pressure across the flow control valve 6*a* with the differential pressure ΔPLS as a target differential pressure for pressure compensation. The pressure compensating valves 7*b*, 7*c* are also of the same construction.

Since the pressure compensating valves 7*a*, 7*b*, 7*c* control the respective differential pressures across the flow control valves 6*a*, 6*b*, 6*c* with the same differential pressure ΔPLS as a target differential pressure, the differential pressures across the flow control valves 6*a*, 6*b*, 6*c* are all controlled to become equal to the differential pressure ΔPLS and respective flow rates demanded by the flow control valves 6*a*, 6*b*, 6*c* are expressed by the products of the differential pressure ΔPLS and opening areas of those valves.

The plurality of flow control valves 6*a*, 6*b*, 6*c* are provided with load ports 60*a*, 60*b*, 60*c*, respectively, through which load pressures of the actuators 3*a*, 3*b*, 3*c* are taken out during the operation of the actuators 3*a*, 3*b*, 3*c*. A maximum one of the load pressures taken out through the load ports 60*a*, 60*b*, 60*c* is detected by a signal line 10 via load lines 8*a*, 8*b*, 8*c*, 8*d* and shuttle valves 9*a*, 9*b*, the detected pressure being applied as the maximum load pressure PLS to the pressure compensating valves 7*a*, 7*b*, 7*c*.

The hydraulic pump 2 is a swash plate pump wherein a delivery rate is increased by increasing a tilting angle of a swash plate 2*a*. The pump displacement control system 5 comprises a servo piston 20 for tilting the swash plate 2*a* of the hydraulic pump 2, and a tilting control unit 21 for driving the servo piston 20 to control the tilting angle of the swash plate 2*a*, thereby controlling the displacement of the hydraulic pump 2. The servo piston 20 is operated in accordance with a pressure introduced from the delivery line 100 (the delivery pressure Ps of the hydraulic pump 2) and a command pressure from the tilting control unit 21. The tilting control unit 21 includes a first tilting control valve 22 and a second tilting control valve 23.

The first tilting control valve 22 is a horsepower control valve for reducing the delivery rate of the hydraulic pump 2 as the pressure introduced from the delivery line 100 (the delivery pressure Ps of the hydraulic pump 2) rises. The first tilting control valve 22 receives the delivery pressure Ps of the hydraulic pump 2, as an original pressure, and if the delivery pressure Ps of the hydraulic pump 2 is lower than a predetermined level set by a spring 22*a*, a spool 22*b* is moved to the right on the drawing, causing the delivery pressure Ps of the hydraulic pump 2 to be output as it is. At this time, if the output pressure is directly applied as a command pressure to the servo piston 20, the servo piston 20 is moved to the left on the drawing due to an area difference thereof between the opposite sides, whereupon the tilting angle of the swash plate 2*a* is increased to increase the delivery rate of the hydraulic pump 2. As a result, the delivery pressure Ps of the hydraulic pump 2 rises. When the delivery pressure Ps of the hydraulic pump 2 exceeds the predetermined level set by the spring 22*a*, the spool 22*b* is moved to the left on the drawing to reduce the delivery pressure Ps and a resulting reduced pressure is output as a command pressure. Accordingly, the servo piston 20 is moved to the right on the drawing, whereupon the tilting angle of the swash plate 2*a* is diminished to reduce the delivery rate Ps of the hydraulic pump 2.

The second tilting control valve 23 is a load sensing control valve for controlling the differential pressure ΔPLS between the delivery pressure Ps of the hydraulic pump 2 and the maximum load pressure PLS among the actuators 3*a*, 3*b*, 3*c* to be maintained at the target differential pressure ΔPLSref. The second tilting control valve 23 comprises a spring 23*a* for setting a basic value of the target differential pressure ΔPLSref, a spool 23*b*, and a first operation driver 24 operated in accordance with the pressure introduced from the delivery line 100 (the delivery pressure Ps of the hydraulic pump 2) and the maximum load pressure PLS among the actuators 3*a*, 3*b*, 3*c*, for thereby moving the spool 23*b*.

The first operation driver 24 comprises a piston 24*a* acting on the spool 23*b* and two hydraulic pressure chambers 24*b*, 24*c* divided by the piston 24*a*. The delivery pressure Ps of the hydraulic pump 2 is introduced to the hydraulic pressure chamber 24*b*, and the maximum load pressure PLS is introduced to the hydraulic pressure chamber 24*c* with the spring 23*a* built in the hydraulic pressure chamber 24*c*.

Further, the second tilting control valve 23 receives the output pressure of the first tilting control valve 22, as an original pressure. When the differential pressure ΔPLS is lower than the target differential pressure ΔPLSref, the spool 23*b* is moved by the first operation driver 24 to the left on the drawing, causing the output pressure of the first tilting control valve 22 to be output as it is. At this time, if the output pressure of the first tilting control valve 22 is given by the delivery pressure Ps of the hydraulic pump 2, the delivery pressure Ps is applied as a command pressure to the servo piston 20. The servo piston 20 is therefore moved to the left on the drawing due to the area difference thereof between the opposite sides, whereupon the tilting angle of the swash plate 2*a* is increased to increase the delivery rate of the hydraulic pump 2. As a result, the delivery pressure Ps of the hydraulic pump 2 rises and the differential pressure ΔPLS also rises. On the other hand, when the differential pressure ΔPLS is higher than the target differential pressure ΔPLSref, the spool 23*b* is moved by the first operation driver 24 to the right on the drawing to reduce the output pressure of the first tilting control valve 22 and a resulting reduced pressure is output as a command pressure. Accordingly, the servo piston 20 is moved to the right on the drawing, whereupon the tilting angle of the swash plate 2*a* is diminished to reduce the delivery rate of the hydraulic pump 2. As a result, the differential pressure ΔPLS is maintained at the target differential pressure ΔPLSref.

Here, the differential pressures across the flow control valves 6*a*, 6*b*, 6*c* are controlled respectively by the pressure compensating valves 7*a*, 7*b*, 7*c* so as to become the same value, i.e., the differential pressure ΔPLS. Therefore, maintaining the differential pressure ΔPLS at the target differential pressure ΔPLSref, as explained above, eventually results in that the differential pressures across the flow control valves 6*a*, 6*b*, 6*c* are maintained at the target differential pressure ΔPLSref.

The pump displacement control system 5 further comprises setting modifying means 38 for modifying the target differential pressure ΔPLSref applied to the second tilting control valve 23 depending on change in rotational speed of the engine 1. The setting modifying means 38 is made up of a fixed displacement hydraulic pump 30 driven by the engine 1 along with the variable displacement hydraulic pump 2, a flow rate detecting valve 31 disposed to be intermediate between delivery lines 30*a*, 30*b* of the fixed displacement hydraulic pump 30 and having a variable throttle 31*a* of which an opening area is continuously adjustable, and a second operation driver 32 for modifying the target differential pressure ΔPLSref depending on a differential pressure ΔPp across the variable throttle 31*a* of the flow rate detecting valve 31.

The fixed displacement hydraulic pump 30 is one that is usually provided to serve as a pilot hydraulic fluid source. A relief valve 33 for specifying an original pressure supplied from the pilot hydraulic fluid source is connected to the delivery line 30*b*, and the delivery line 30*b* is further connected to a remote control valve (not shown) for producing a pilot pressure used to shift the flow control valves 6*a*, 6*b*, 6*c*, for example.

The second operation driver 32 is an additional operation driver integrated with the first operation driver 24 of the second tilting control valve 23, and comprises a piston 32*a* acting on the piston 24*a* of the first operation driver 24 and two hydraulic pressure chambers 32*b*, 32*c* divided by the piston 32*a*. A pressure upstream of the flow rate detecting valve (variable throttle 31*a*) is introduced to the hydraulic pressure chamber 32*b* via a pilot line 34*a* and a pressure downstream of the flow rate detecting valve (variable throttle 31*a*) is introduced to the hydraulic pressure chamber 32*c* via a pilot line 34*b*, causing the piston 32*a* to urge the piston 24*a* to the left on the drawing by a force corresponding to the differential pressure ΔPp across the variable throttle 31*a* of the flow rate detecting valve 31. The target differential pressure ΔPLSref provided by the second tilting control valve 23 is set in accordance with the basic value provided by the spring 23*a* and the urging force of the piston 32*a*. As the differential pressure ΔPp across the variable throttle 31*a* of the flow rate detecting valve 31 becomes smaller, the piston 32*a* pushes the piston 24*a* by a smaller force to reduce the target differential pressure ΔPLSref. As the differential pressure ΔPp becomes larger, the piston 32*a* pushes the piston 24*a* by a larger force to increase the target differential pressure ΔPLSref. Here, the differential pressure ΔPp across the variable throttle 31*a* of the flow rate detecting valve 31 varies depending on the rotational speed of the engine 1 (as described later). The second operation driver 32 thus modifies the target differential pressure ΔPLSref provided by the second tilting control valve 23 depending on the engine rotational speed.

The flow rate detecting valve 31 is constructed such that the opening area of the variable throttle 31*a* is changed depending on the differential pressure ΔPp across the variable throttle 31*a* itself. More specifically, the flow rate detecting valve 31 comprises a valve body 31*b*, a spring 31*c* acting on the valve body 31*b* in the direction to reduce the opening area of the variable throttle 31*a*, a control pressure chamber 31*d* acting on the valve body 31*b* in the direction to increase the opening area of the variable throttle 31*a*, and a control pressure chamber 31*e* acting on the valve body 31*b* in the direction to reduce the opening area of the variable throttle 31*a*. The pressure upstream of the variable throttle 31*a* is introduced to the control pressure chamber 31*d* via a pilot line 34*a* and the pressure downstream of the variable throttle 31*a* is introduced to the control pressure chamber 31*e* via a pilot line 34*b*.

The opening area of the variable throttle 31*a* is determined by balance among a force of the spring 31*c* and urging forces of the control pressure chambers 31*d*, 31*e*. As the differential pressure ΔPp across the variable throttle 31*a* becomes smaller, the valve body 31*b* is moved to the right on the drawing to reduce the opening area of the variable throttle 31*a*. As the differential pressure ΔPp becomes larger, the valve body 31*b* is moved to the left on the drawing to increase the opening area of the variable throttle 31*a*.

Then, the differential pressure ΔPp across the variable throttle 31*a* varies depending on the rotational speed of the engine 1. Specifically, as the rotational speed of the engine 1 lowers, the delivery rate of the hydraulic pump 30 is reduced and the differential pressure ΔPp across the variable throttle 31*a* is also reduced. The control pressure chambers 31*d*, 31*e* and the spring 31*c*, therefore, function as throttle adjusting means for adjusting the opening area of the variable throttle 31*a* to become smaller as the rotational speed of the engine 1 lowers.

Figure 2:
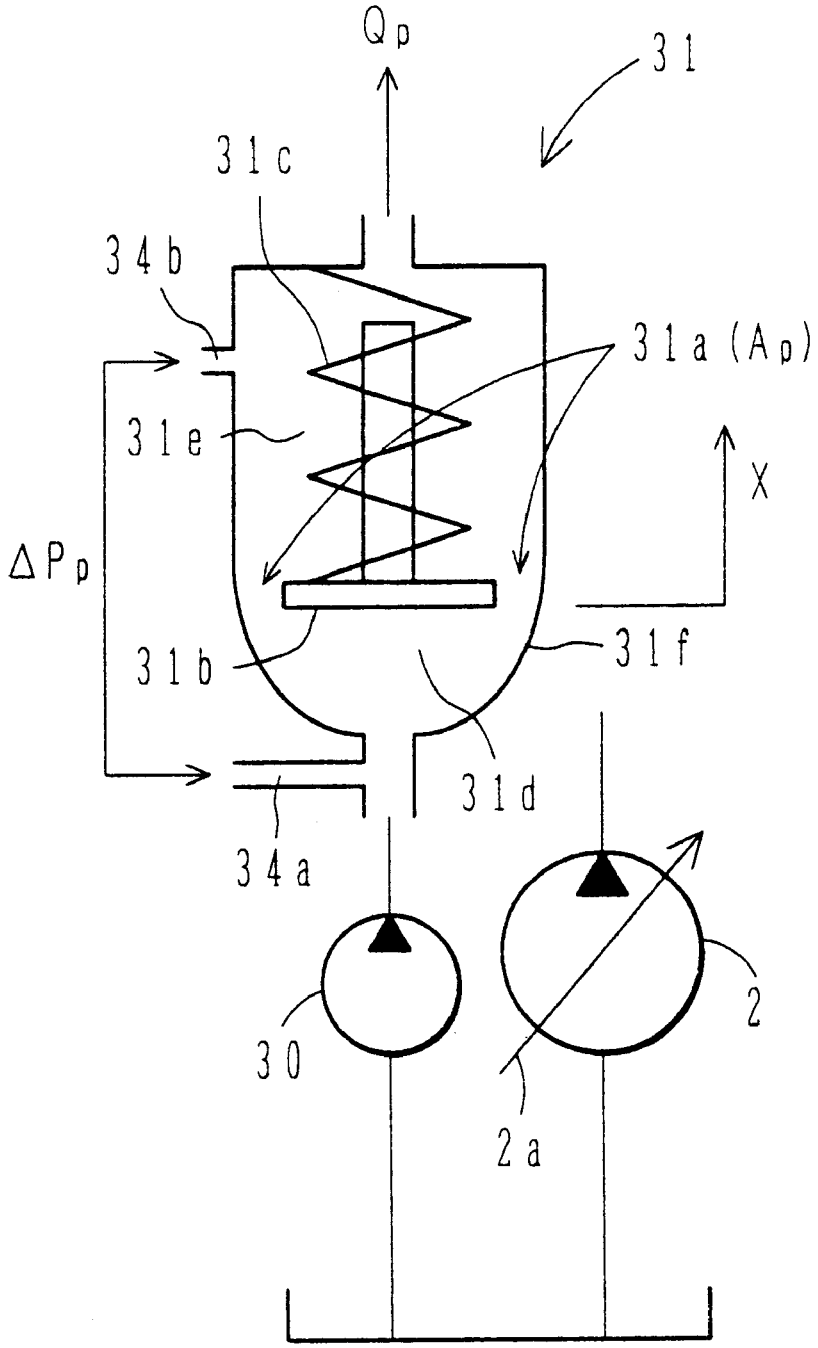
FIG. 2 is a diagram showing details of a flow rate detecting valve shown in FIG. 1.

FIG. 2 shows an internal structure of the flow rate detecting valve 31. In FIG. 2, a piston serving as the valve body 31*b* moves within a casing 31*f* and the area of a gap defined therebetween provides an opening area Ap of the variable throttle 31*a*. The piston 31*b* is supported by the spring 31*c*, and a resilient force F of the spring 31*c* acts on the piston 31*b* in the direction to reduce the opening area of the variable throttle 31*a*. Due to a flow of the hydraulic fluid in the casing 31*f*, the differential pressure ΔPp across the variable throttle 31*a* produces a force acting on the piston 31*b* in the direction to increase the opening area Ap of the variable throttle 31*a*. The piston 31*b* comes to a standstill in a position x where the above two forces are balanced. Since the resilient force F is proportional to a displacement x of the piston 31*b* with a spring constant K of the spring 31*c* as a constant of proportionality (F=Kx), the differential pressure ΔPp across the variable throttle 31*a* is eventually proportional to the displacement x of the piston 31*b* (ΔPp x). The relationship between the displacement x of the piston 31*b* and the opening area Ap of the variable throttle 31*a* depends on a shape of the casing 31*f*. In this embodiment, the casing 31*f* has a parabolic shape symmetrical with respect to the direction of displacement of the piston 31*b*.

The operation and resulting effect of the setting modifying means 38 including the flow rate detecting valve 31, constructed as explained above, will now be described below.

The fixed displacement hydraulic pump 30 delivers the hydraulic fluid at a flow rate Qp expressed by the product of a rotational speed N of the engine 1 and a pump displacement Cm.

$$Qp=CmN \tag{1}$$

Given the opening area of the variable throttle 31*a* of the flow rate detecting valve 31 being Ap, the rotational speed N of the engine 1 and the differential pressure ΔPp across the variable throttle 31*a* are related to each other by the following formula:

$$Qp=cAp\sqrt{(2/\rho)\Delta Pp} \tag{2}$$

$$\Delta Pp=(\rho/2)(Qp/cAp)^2=(\rho/2)(CmN/cAp)^2 \tag{3}$$

Figure 3A:
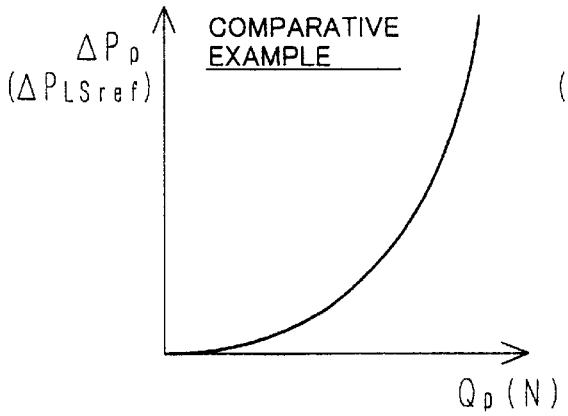
FIGS. 3A to 3E are graphs showing the operation of the flow rate detecting valve in the first embodiment and the operation of a conventional valve for comparison between them.

Assuming now that the opening area Ap of the variable throttle 31*a* is not changed and remains constant (this case will be referred to as a comparative example hereinafter), the differential pressure ΔPp across the variable throttle 31*a* increases following a curve of secondary degree with respect to the delivery rate Qp of the hydraulic pump 30 or the rotational speed N of the engine 1 based on the formula (3), as shown in FIG. 3A. Also, since the relationship of ΔPLSref ΔPp holds by virtue of the second operation driver 32, the load sensing setting differential pressure ΔPLSref also increases following a curve of secondary degree with respect to the delivery rate Qp of the hydraulic pump 30 or the rotational speed N of the engine 1, as shown in FIG. 3A.

Further, in the case where the differential pressure ΔPLS across one of the flow control valves 6*a*, 6*b*, 6*c*, e.g., the flow control valve 6*a*, is controlled to the target differential pressure ΔPLSref, a flow rate Qv demanded by the flow control valve 6*a* is expressed by the following formula given an opening area of the flow control valve 6*a* being Av:

$$Qv=cAv\sqrt{(2/\rho)\Delta PLSref} \tag{4}$$

Figure 3B:
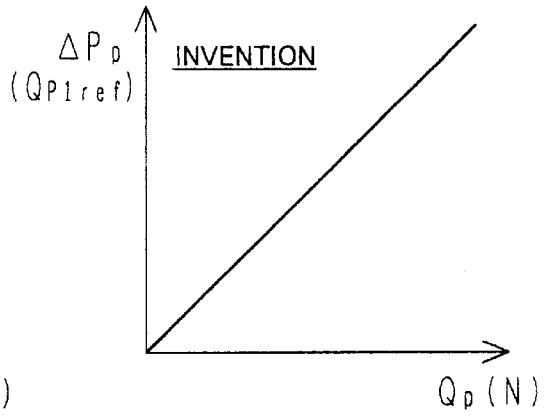
Figure 3C:
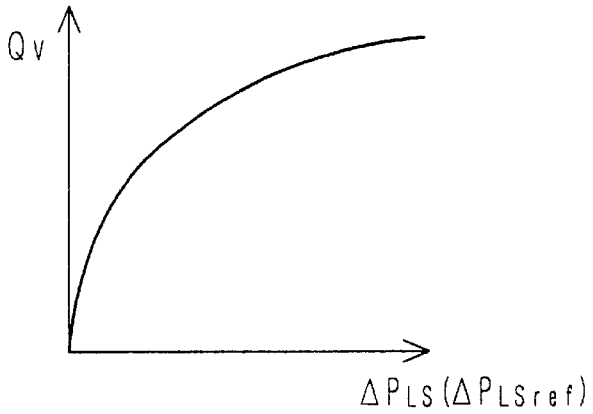

Thus the demanded flow rate Qv increases following a curve of secondary degree with respect to the target differential pressure ΔPLSref, as shown in FIG. 3C.

Here, the target differential pressure ΔPLSref across the flow control valve 6*a* is given by the differential pressure ΔPp across the variable throttle 31*a* of the flow rate detecting valve 31 (ΔPLSref ΔPp). Based on the formula (3), therefore, the demanded flow rate Qv can be related to the rotational speed N of the engine 1 by the following formula:

$$Qv \quad (Av/Ap)CmN \tag{5}$$

Figure 3D:
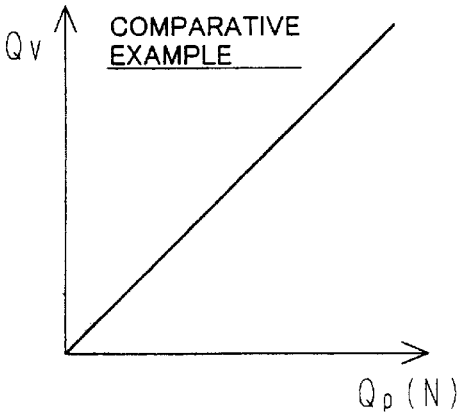

Stated otherwise, as a combined result of the relationship between the flow rate Qp and the differential pressure ΔPp across the variable throttle 31*a* expressed by a curve of secondary degree (formula (3)) shown in FIG. 3A and the relationship between the differential pressure ΔPLS across the flow control valve 6*a* and the demanded flow rate Qv thereof expressed by a curve of secondary degree (formula (4)) shown in FIG. 3C, the demanded flow rate Qv increases almost linearly with respect to the rotational speed N of the engine 1, as shown in FIG. 3D.

The above explanation is made for one flow control valve 6*a*. When driving a plurality of, e.g., two or three, actuators, the relationship of FIG. 3D is obtained for each of the flow control valves 6*a*, 6*b* or 6*a*, 6*b*, 6*c*, and the relationship between the rotational speed N of the engine 1 and a total of respective demanded rates Qv is given as one resulted from simply adding the relationship of FIG. 3D two or three times.

Figure 4:
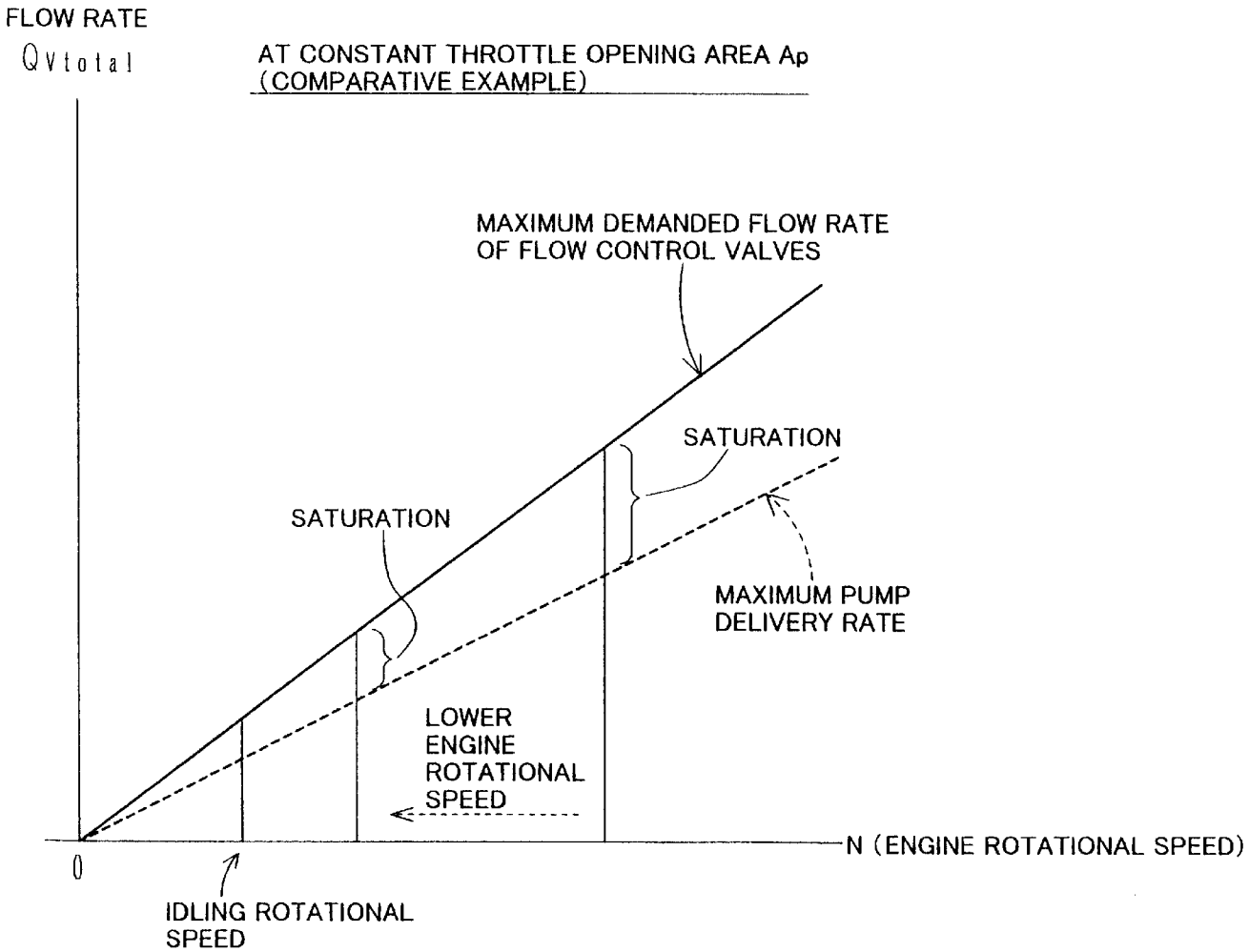
FIG. 4 is a graph showing the relationships of an engine rotational speed versus a maximum demanded flow rate of flow control valves and a maximum pump delivery rate in a conventional system.

FIG. 4 shows the relationships of the rotational speed N of the engine 1 versus a total maximum demanded flow rate Qvtotal of any two of the flow control valves 6*a*, 6*b*, 6*c*, e.g., the flow control valves 6*a*, 6*b*, (i.e., total of the flow rates Qv demanded by the flow control valves 6*a*, 6*b* at maximum opening areas thereof) and a maximum delivery rate Qsmax of the variable displacement hydraulic pump 2. FIG. 4 represents an example in which the opening area Ap of the variable throttle 31*a* of the flow rate detecting valve 31 is constant as stated above. When the actuators 3*a*, 3*b* are driven at the same time, a ratio of the total maximum demanded flow rate Qvtotal of the flow control valves 6*a*, 6*b* to the maximum delivery rate Qsmax of the hydraulic pump 2 does not change regardless of change in the rotational speed N of the engine 1; hence a shortage of the flow rate accompanying a saturation phenomenon during the combined operation occurs at the same proportion over an entire range of the rotational speed N of the engine 1.

By contrast, the present invention is constructed such that the opening area Ap of the variable throttle 31*a* of the flow rate detecting valve 31 is changed depending on the differential pressure across the variable throttle 31*a*. In a case that the casing 31*f* of the flow rate detecting valve 31 shown FIG. 2 has a parabolic shape symmetrical with respect to the direction of displacement of the piston 31*b* as stated above, the relationship between the opening area Ap of the variable throttle 31*a* and the differential pressure ΔPp across the variable throttle 31*a* is expressed by the following formula:

$$Ap=a\sqrt{\Delta Pp} \quad (6)$$

From the formula (2), the relationship between the delivery rate Qp of the fixed displacement hydraulic pump 30 and the differential pressure ΔPp across the variable throttle 31*a* is expressed by the following formula (7):

$$\Delta Pp=(1/Ca)\sqrt{(\rho/2)Qp}$$
$$,=(Cm/Ca)\sqrt{(\rho/2)}\cdot N \quad (7)$$

Thus the differential pressure ΔPp across the variable throttle 31*a* increases linearly with respect to the delivery rate Qp of the hydraulic pump 30 or the rotational speed N of the engine 1, as shown in FIG. 3B.

Also, from the relationship of ΔPLSref ΔPp, the relationship between the demanded flow rate Qv of the flow control valve ta and the rotational speed N of the engine 1 is expressed by the following formula (8) similarly to the formula (5):

$$Qv\ \ cAv\sqrt{(Cm/Ca)\ (2/\rho)^{+e,fra\ 1/2}+ee}\cdot\sqrt{N} \quad (8)$$

Figure 3E:
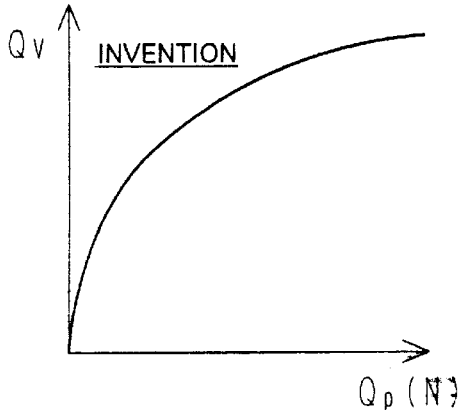

Stated otherwise, as a combined result of the relationship between the flow rate Qp and the differential pressure ΔPp across the variable throttle 31*a* expressed by linear proportion (formula (7)) shown in FIG. 3B and the relationship between the differential pressure ΔPLS across the flow control valve 6*a* and the demanded flow rate Qv thereof expressed by a curve of secondary degree (formula (4)) shown in FIG. 3C, the demanded flow rate Qv increases following a curve of secondary degree with respect to the rotational speed N of the engine 1, as shown in FIG. 3E.

Also, in this case, when driving a plurality of, e.g., two or three, actuators, the relationship of FIG. 3E is obtained for each of the flow control valves 6*a*, 6*b* or 6*a*, 6*b*, 6*c*, and the relationship between the rotational speed N of the engine 1 and a total of respective demanded rates Qv is given as one resulted from simply adding the relationship of FIG. 3E two or three times.

Figure 5:
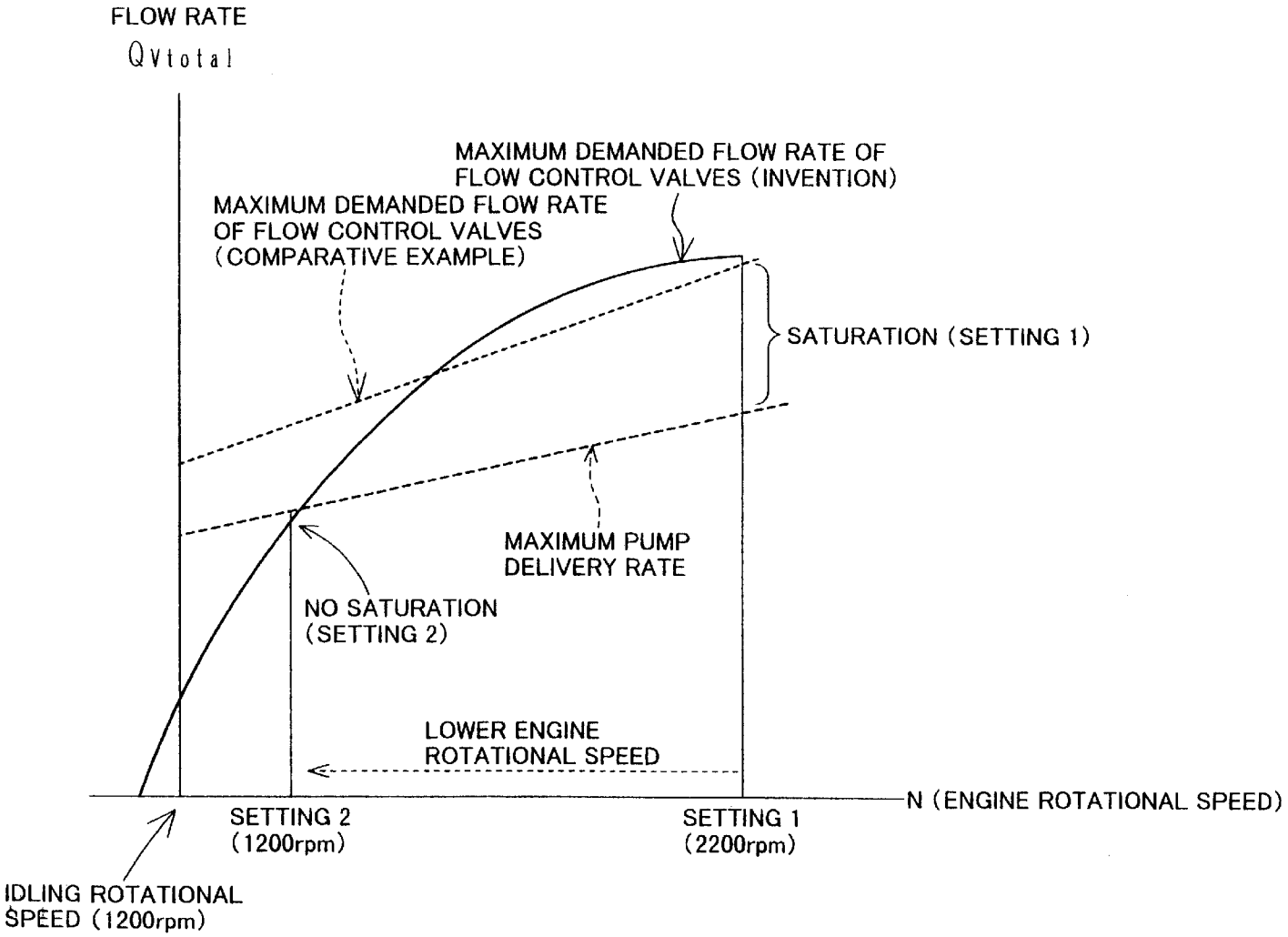
FIG. 5 is a graph showing the relationships of an engine rotational speed versus a maximum demanded flow rate of flow control valves and a maximum pump delivery rate as resulted from the provision of the flow rate detecting valve in the first embodiment.

FIG. 5 shows the relationships of the rotational speed N of the engine 1 versus a total maximum demanded flow rate Qvtotal of any two of the flow control valves 6*a*, 6*b*, 6*c*, e.g., the flow control valves 6*a*, 6*b*, (i.e., total of the flow rates Qv demanded by the flow control valves 6*a*, 6*b* at maximum opening areas thereof) and a maximum delivery rate Qsmax of the variable displacement hydraulic pump 2, the relationships being resulted based on FIG. 3E or the formula (8).

In FIG. 5, at setting 1 where the rotational speed N of the engine 1 is set to be suitable for carrying out ordinary work, the system is under a condition giving rise to saturation because the total maximum demanded flow rate Qvtotal of the flow control valves 6*a*, 6*b* when driving the plural actuators 3*a*, 3*b* is greater than the maximum delivery rate of the variable displacement hydraulic pump 2. On the other hand, at setting 2 where the rotational speed N of the engine 1 is set to a low value, the total maximum demanded flow rate Qvtotal of the flow control valves 6*a*, 6*b* is reduced to become smaller than the maximum delivery rate of the hydraulic pump 2 and hence no saturation occurs.

Here, the setting 2 represents an engine rotational speed suitable for fine operation. Specifically, since it is generally said that a rotational speed lower than the middle between the rated rotational speed and the lowest rotational speed is suitable for fine operation, the setting 2 corresponds to a rotational speed lower than the middle rotational speed.

Assuming, for example, that the rated rotational speed of the engine 1 is 2,200 rpm and the lowest rotational speed (idling rotational speed) is 1,000 rpm, the middle rotational speed is 1,600 rpm and the setting 2 represents a rotational speed lower than 1,600 rpm. In the illustrated example, the setting 2 represents 1,200 rpm. Additionally, in the illustrated example, "the setting 1" represents the rated rotational speed of 2,200 rpm.

As explained above, the flow rate detecting valve 31 is constructed to have a larger opening area when the engine rotational speed is in a region including the lowest rotational speed than when it is in a region including the rated rotational speed. The setting modifying means 38 made up of the flow rate detecting valve 31, the fixed displacement hydraulic pump 30 and the second operation driver 32 detects a rotational speed of the engine 1, and when the detected engine rotational speed is in the region including the lowest rotational speed, the means 38 modifies the setting value ΔPLSref of the pump displacement control system 5 so that the total maximum demanded flow rate Qvtotal of the plural flow control valves 6*a*, 6*b*, which is expressed based on the products of the differential pressure ΔPLS and the respective opening areas of the plural flow control valves 6*a*, 6*b*, is smaller than the maximum delivery rate Qsmax of the hydraulic pump 2 determined by the engine rotational speed at that time.

Figure 6:
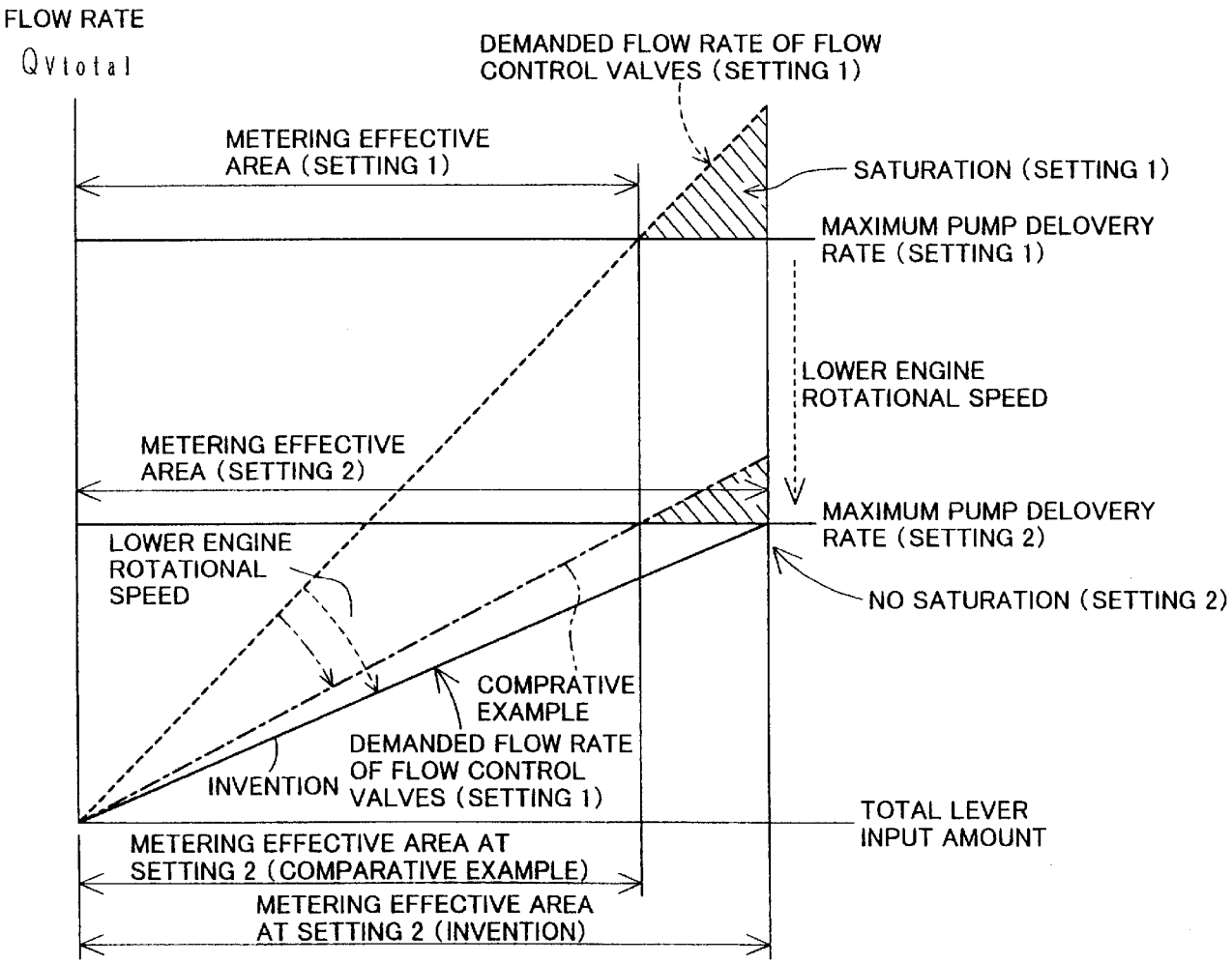
FIG. 6 is a graph showing the relationship between a total lever input amount and a flow rate passing through the flow control valves as resulted from the provision of the flow rate detecting valve in the first embodiment.

FIG. 6 shows characteristics of the setting modifying means 38 in terms of the relationship between a total lever input amount applied from an operator to the flow control valves 6*a*, 6*b* and the total demanded flow rate of the flow control valves 6*a*, 6*b* (total flow rate passing therethrough).

In FIG. 6, as the engine rotational speed lowers, the maximum flow rate Qsmax capable of being supplied from the hydraulic pump 2 to the flow control valves is reduced. Concurrently, the total demanded flow rate Qvtotal of the flow control valves 6*a*, 6*b* corresponding to the total lever input amount is reduced to become lower than the maximum delivery rate Qsmax of the hydraulic pump 2. Thus a gradient of the line representing change in the flow rate passing through the flow control valves 6*a*, 6*b* is so reduced as to ensure a wide metering effective area.

In the above-mentioned comparative example, since, the ratio of the total maximum demanded flow rate Qvtotal of the flow control valves 6*a*, 6*b* to the maximum delivery rate Qsmax of the hydraulic pump 2 does not change despite a lowering of the rotational speed N of the engine 1 and a shortage of the flow rate accompanying with a saturation phenomenon occurs at the same proportion as shown in FIG. 4, a gradient of the line representing change in the flow rate passing through the flow control valves 6*a*, 6*b* is so large as to narrow the metering effective area, as indicated by a one-dot-chain line in FIG. 6.

Consequently, in the present invention, when the operator sets the engine rotational speed to a low value with the intent to carry out slow-speed operation, there occurs no saturation even with combined lever operations which give rise to saturation at the ordinary setting of the engine rotational speed; hence good operability can be realized using the wide metering effective area.

Figure 7:
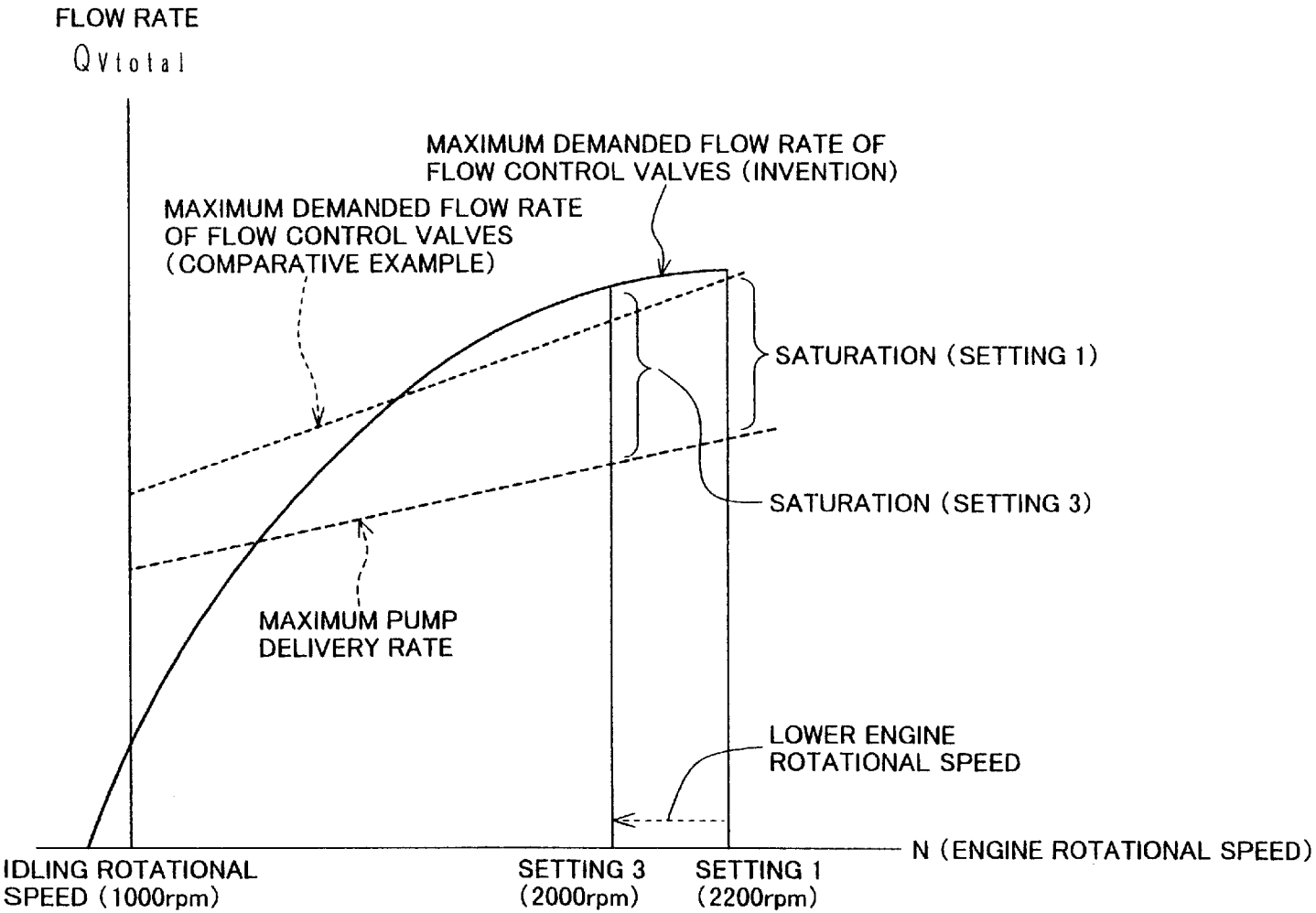
FIG. 7 is a graph showing the relationships of an engine rotational speed versus a maximum demanded flow rate of flow control valves and a maximum pump delivery rate as resulted from the provision of the flow rate detecting valve in the first embodiment.
Figure 8:
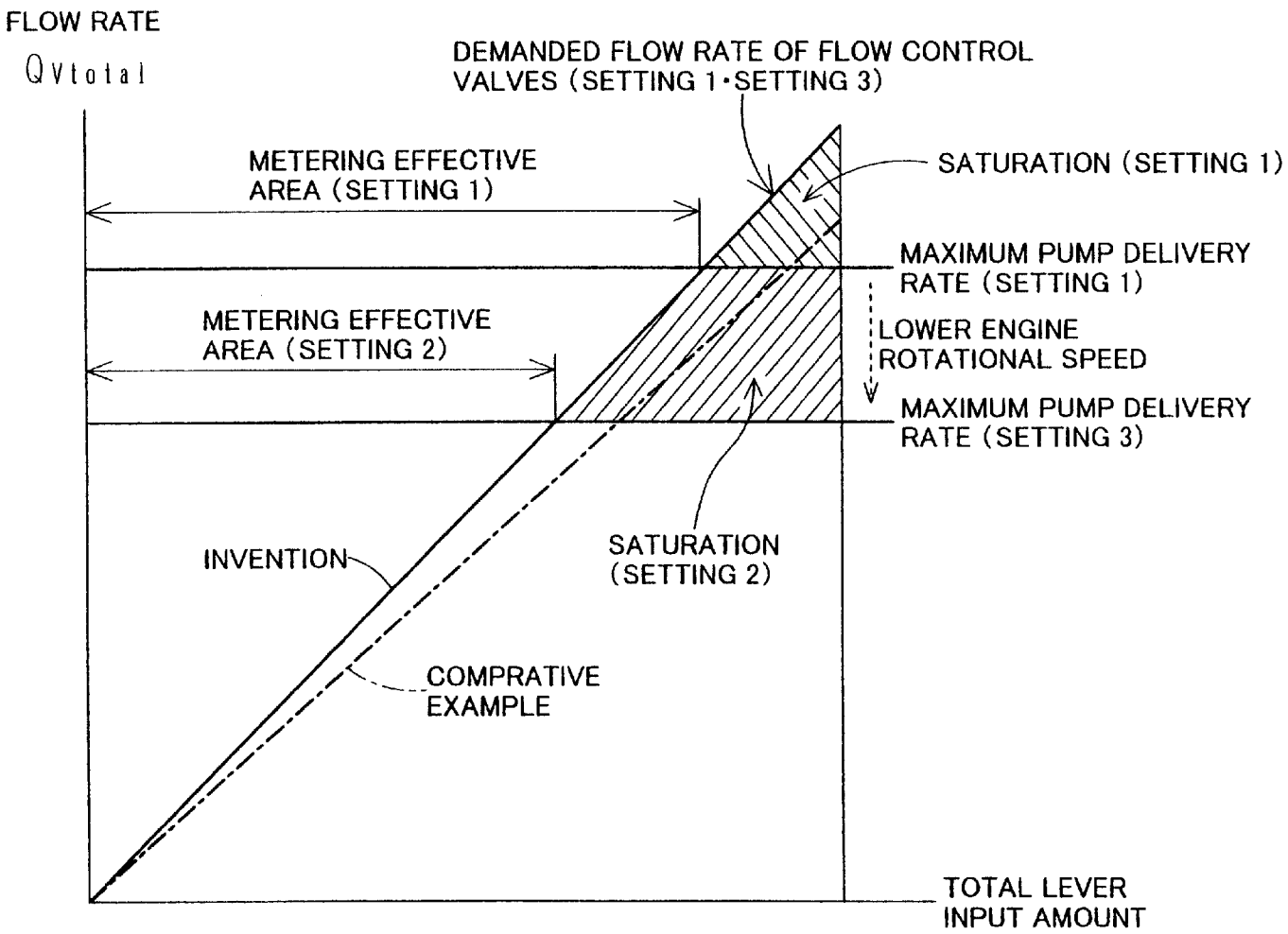
FIG. 8 is a graph showing the relationship between a total lever input amount and a flow rate passing through the flow control valves as resulted from the provision of the flow rate detecting valve in the first embodiment.

Furthermore, in FIG. 7, at setting 3 where the rotational speed N of the engine 1 is set to a value (e.g., around 2,000 rpm) slightly lower than at the ordinary setting (setting 1), the total maximum demanded flow rate Qvtotal of the flow control valves 6*a*, 6*b* is reduced a little from that at the ordinary setting (setting 1), but the amount of change is so small that the total maximum demanded flow rate Qvtotal of the flow control valves 6*a*, 6*b* is held at a higher value than that resulted when providing the setting 3 in the comparative example. In such a condition, a saturation phenomenon tends to easily occur at engine rotational speeds around the setting value (setting 1) suitable for ordinary work. As indicated by a solid line in FIG. 8, however, a gradient of the line representing change in the flow rate passing through the flow control valves 6*a*, 6*b* with respect to the total lever input amount is not virtually changed from the gradient resulted at the setting 1. Accordingly, even when the rotational speed of the engine 1 is varied to some extent from the setting suitable for ordinary work, the operating speed of the actuator is kept at the same level and the operation can be performed with good response. In the comparative example, as indicated by a one-dot-chain line in FIG. 8, the gradient of the line representing change in the flow rate passing through the flow control valves 6*a*, 6*b* with respect to the total lever input amount is somewhat diminished, whereby the operating speed and response of the actuator are reduced correspondingly.

Here, in ordinary work, grater importance is placed on response and powerful movement of the actuator rather than operability having a wider metering effective area from the practical point of view. Consequently, the present invention can provide the operator with a good feeling in the operation.

With this embodiment, as stated above, a saturation phenomenon is improved in consideration of the engine rotational speed such that when the engine rotational speed is set to a low value, good operability in fine operation can be achieved, and when the engine rotational speed is set to a high value, a powerful feeling can be realized in the operation with good response. It is thus possible to establish the system setting adapted for the purpose of work intended by the operator based on setting of the engine rotational speed.

Further, the relationship between the saturation phenomenon and the total lever input amount during the combined operation is freely adjustable depending on the shape of the casing 31*f* of the flow rate detecting valve 31.

Additionally, in this embodiment, the characteristic of the maximum demanded flow rate Qvtotal, shown in FIG. 5, is obtained by forming the casing 31*f* of the flow rate detecting valve 31 to have a parabolic shape. However, the shape of the casing 31*f* may be a quasi-parabolic shape built up by combining a plurality of straight lines so long as when the engine rotational speed is in the region including the lowest rotational speed, the maximum demanded flow rate Qvtotal is smaller than the maximum delivery rate Qsmax of the hydraulic pump 2 determined by the engine rotational speed at that time. In this case, the casing 31*f* can be manufactured more easily.

Figure 9:
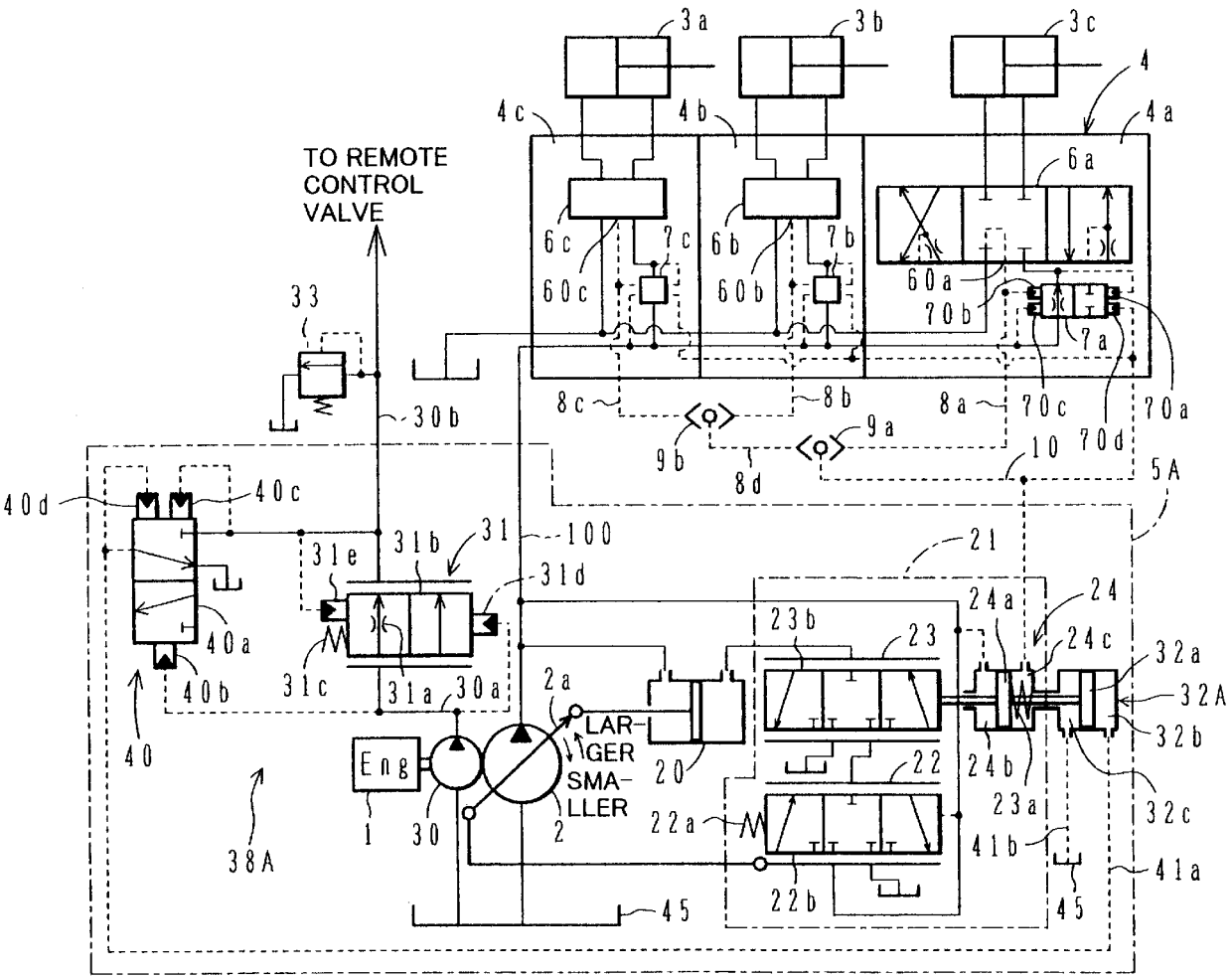
FIG. 9 is a hydraulic circuit diagram showing the configuration of a hydraulic drive system and a pump displacement control system according to a second embodiment of the present invention.

A second embodiment of the present invention will be described below with reference to FIG. 9. In FIG. 9, equivalent members to those in FIG. 1 are denoted by the same reference numerals and are not described here.

Referring to FIG. 9, in a pump displacement control system 5A of this embodiment, setting modifying means 38A includes a pressure control valve 40 for outputting a signal pressure which corresponds to the differential pressure ΔPp across the variable throttle 31*a* of the flow rate detecting valve 31. The pressure control valve 40 has a pressure control chamber 40*b* urging a valve body 40*a* in the direction to increase pressure, and pressure control chambers 40*c*, 40*d* urging the valve body 40*a* in the direction to reduce pressure. The pressure upstream of the variable throttle 31*a* is introduced to the control pressure chamber 40*b*, whereas the pressure downstream of the variable throttle 31*a* and an output pressure of the pressure control valve 40 itself are introduced to the control pressure chambers 40*c*, 40*d*, respectively. The signal pressure which corresponds to the differential pressure ΔPp across the variable throttle 31*a* is produced as an absolute pressure based on balance among the above pressures. The signal pressure is introduced to the hydraulic pressure chamber 32*b* of the second operation driver 32A via a pilot line 41*a*, and the hydraulic pressure chamber 32*c* of the second operation driver 32A is communicated with a reservoir via a pilot line 41*b*.

In this embodiment thus constructed, the second operation driver 32A likewise operates to modify the target differential pressure ΔPLSref depending on the differential pressure ΔPp across the variable throttle 31*a* of the flow rate detecting valve 31.

Accordingly, this embodiment can also provide similar operating advantages as obtainable with the first embodiment.

Further, while the embodiment shown in FIG. 1 requires the two pilot lines 34*a*, 34*b* for respectively introducing the pressure upstream of the flow rate detecting valve 31 and the pressure downstream thereof to the second operation driver 32, this embodiment requires only one pilot line 41*a*, resulting in a simpler circuit configuration. In addition, since the pressure control valve 40 detects the differential pressure as an absolute pressure, the signal pressure is produced at a lower level than the case of detecting the individual pressure as they are, resulting in that the pilot lines 41*a*, 41*b* can be formed of hoses or the like adapted for relatively low pressures and the circuit configuration can be achieved with a lower cost.

A third embodiment of the present invention will be described below with reference to FIGS. 10 to 13. In these drawings, equivalent members to those in FIGS. 1 and 9 are denoted by the same reference numerals and are not described here.

Figure 10:
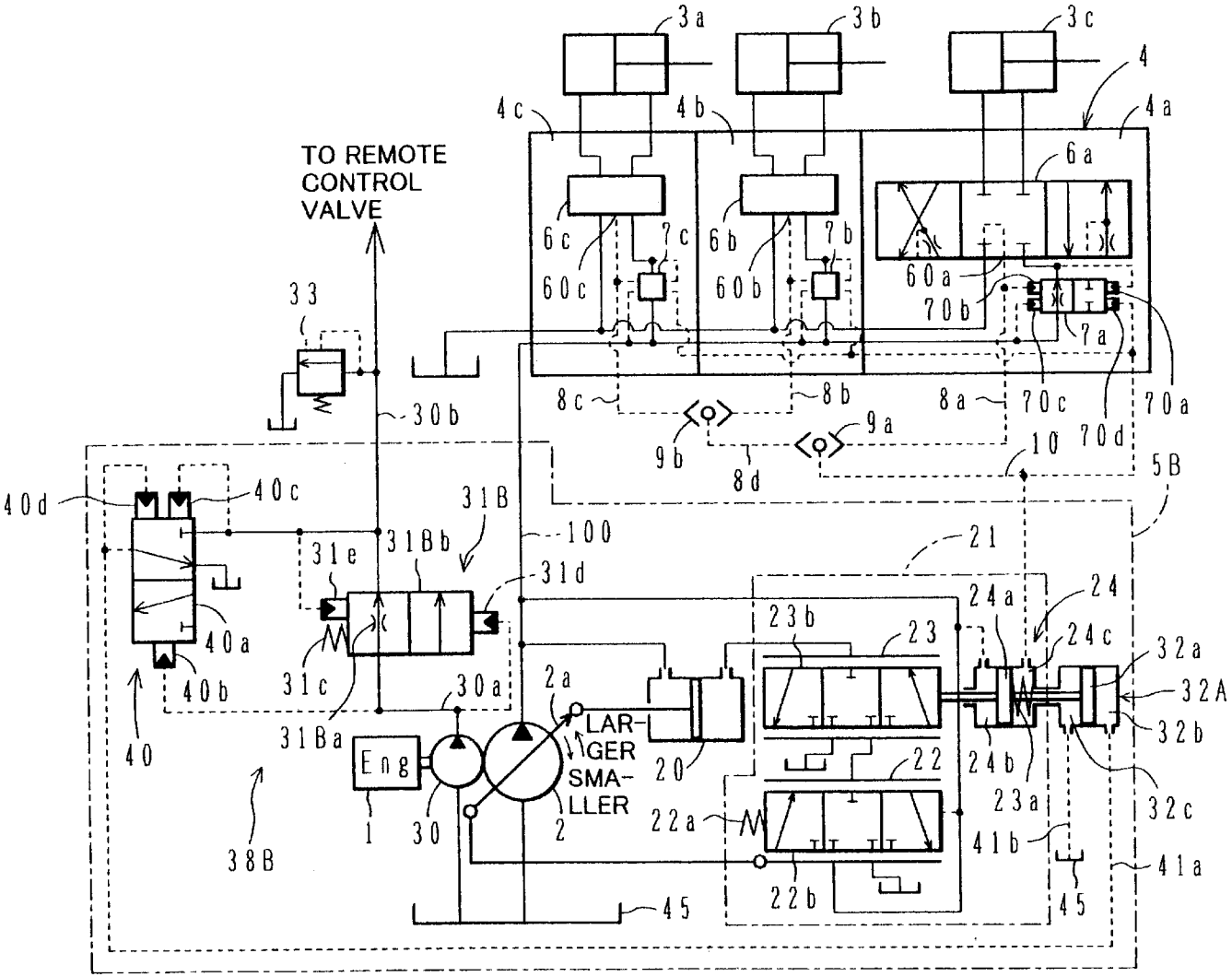
FIG. 10 is a hydraulic circuit diagram showing the configuration of a hydraulic drive system and a pump displacement control system according to a third embodiment of the present invention.

Referring to FIG. 10, in a pump displacement control system 5B of this embodiment, a flow rate detecting valve 31B of setting modifying means 38B has a valve body 31B*b* provided with a fixed throttle 31B*a*. When a differential pressure ΔPp across the flow rate detecting valve 31B introduced to control pressure chambers 31*d*, 31*e* is not larger than a differential pressure corresponding to the resilient force of a spring 31*c* (referred to as a setting differential pressure hereinafter), the flow rate detecting valve 31B is held in a left-hand position on the drawing where the fixed throttle 31B*a* develops its function. When the differential pressure ΔPp across the flow rate detecting valve 31B becomes higher than the setting differential pressure, the flow rate detecting valve 31B is shifted to a right-hand open position on the drawing from the left-hand position on the drawing where the fixed throttle 31B*a* develops its function.

Figure 11:
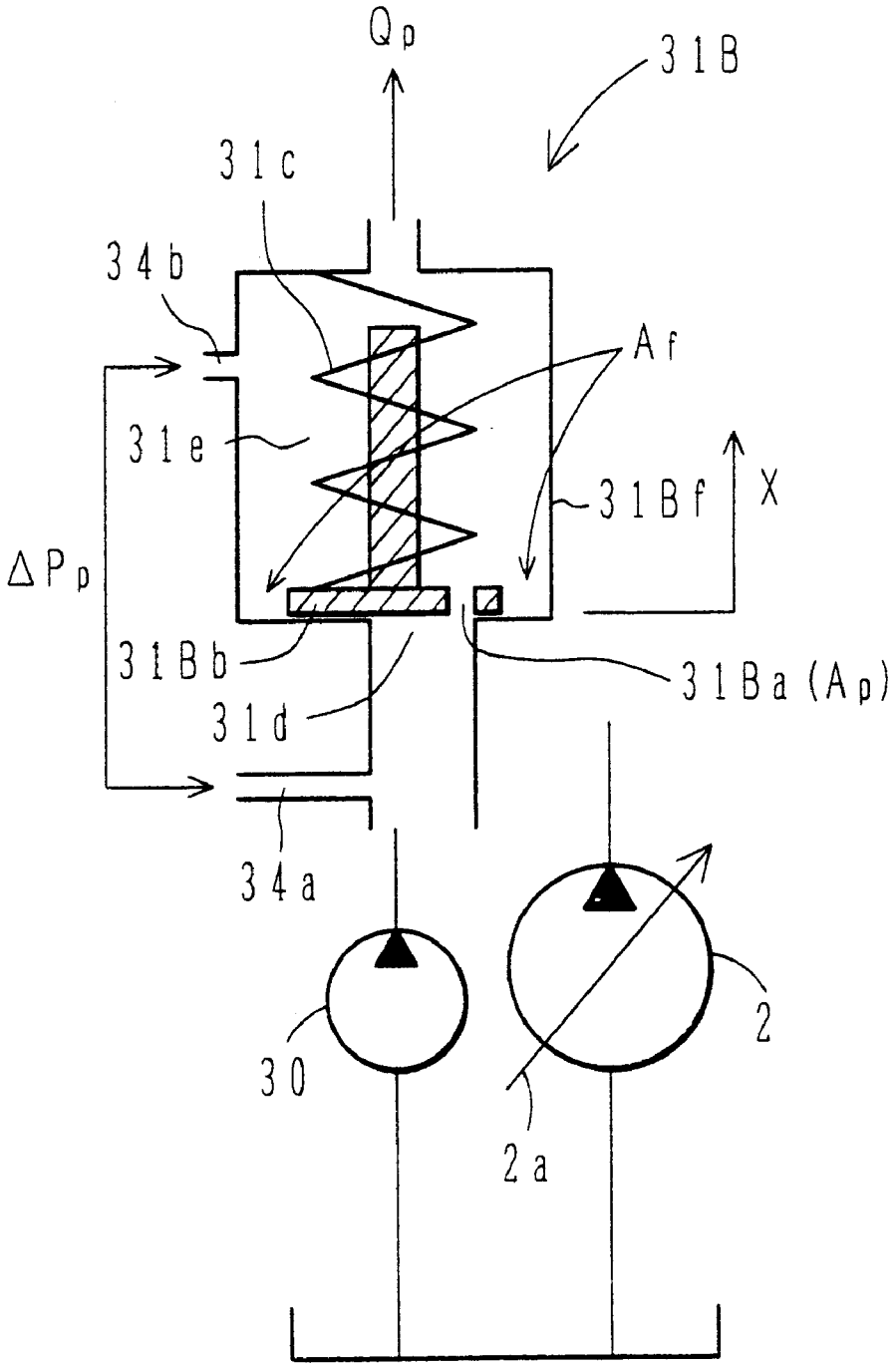
FIG. 11 is a diagram showing details of a flow rate detecting valve shown in FIG. 10.

FIG. 11 shows an internal structure of the flow rate detecting valve 31B. In FIG. 11, a piston serving as the valve body 31B*b* moves within a casing 31Bf and the piston 31B*a* has a small hole formed therein to serve as the fixed throttle 31B*a*. The small hole has an opening area Ap of the fixed throttle 31B*a*. Further, the casing 31B*f* has a cylindrical shape and a gap having an opening area Af is defined between an outer circumferential surface of the piston 31B*b* and an inner circumferential surface of the casing 31B*f*. The opening area Af is selected to a large value enough to prevent the gap from serving as a throttle in fact.

The piston 31B*b* is supported by the spring 31*c*, and a resilient force F of the spring 31*c* acts on the piston 31B*b* in the direction to close an inlet of the casing 31B*f* and to make the function of the fixed throttle 31B*a* effective.

When the inlet of the casing 31B*f* is closed by the piston 31B*b*, the differential pressure ΔPp across the fixed throttle 31B*a* produces a hydraulic force Fh acting on the piston 31B*b* in the direction to open the casing inlet (upward on the drawing) due to a flow of the hydraulic fluid in the casing 31*f* while passing the fixed throttle 31B*a*. When the hydraulic force Fh is smaller than the force F of the spring 31*c*, the piston 31B*b* is held in a state of keeping the inlet of the casing 31B*f* closed, allowing the hydraulic fluid to flow just through the fixed throttle 31B*a*. In other words, the fixed throttle 31B*a* functions effectively.

When a flow rate of the hydraulic fluid delivered from the fixed displacement pump 30 increases and the hydraulic force Fh exceeds the force F of the spring 31*c*, the piston 31B*b* is moved upward to open the casing inlet. In this state, the hydraulic fluid is allowed to flow through the gap having the opening area Af and therefore the fixed throttle 31B*a* does no longer function. Since the hydraulic force Fh is eliminated upon the fixed throttle 31B*a* stopping the function, the piston 31B*b* is moved downward to close the casing inlet. However, as soon as the casing inlet is closed, the hydraulic force is generated to open the casing inlet again. As a result of repeating the above up and down movement, the piston 31B*b* comes to a standstill in a position x where the two forces F and Fh are balanced. In the standstill position, throttle control is performed so that the differential pressure ΔPp across the flow rate detecting valve 31B is maintained at the differential pressure corresponding to the resilient force of a spring 31*c*, i.e., the setting differential pressure.

Here, the differential pressure ΔPp across the flow rate detecting valve 31B introduced to the control pressure chambers 31*d*, 31*e* as explained above varies depending on the rotational speed of the engine 1. Specifically, as the rotational speed of the engine 1 lowers, the delivery rate of the hydraulic pump 30 is reduced and the differential pressure ΔPp across the flow rate detecting valve 31B is also reduced. Accordingly, when the engine rotational speed is lower than an engine rotational speed corresponding to the setting differential pressure specified by the spring 31*c* (referred to as a setting rotational speed hereinafter), the flow rate detecting valve 31B is held in a position where the fixed throttle 31B*a* develops its function (i.e., the left-hand position in FIG. 10), and when the engine rotational speed exceeds the setting rotational speed, the flow rate detecting valve 31B controls a throttle condition so as to maintain the differential pressure ΔPp across the flow rate detecting valve 31B at the setting differential pressure specified by the spring 31*c*.

Stated otherwise, the control pressure chambers 31*d*, 31*e* and the spring 31*c* function as throttle adjusting means for making the fixed throttle 31B*a* effective when the engine rotational speed is in the region including the lowest rotational speed, and controlling the fixed throttle 31B*a* to reduce an increase rate of the differential pressure ΔPp across the flow rate detecting valve 31B when the engine rotational speed rises to a certain setting rotational speed lower than the rated rotational speed. Also, as a result of the above arrangement, the flow rate detecting valve 31B is constructed to have a larger opening area when the engine rotational speed is in the region including the rated rotational speed than when it is in the region including the lowest rotational speed.

The operation and resulting effect of the setting modifying means 38B including the flow rate detecting valve 31B, constructed as explained above, will now be described below.

Figure 12A:
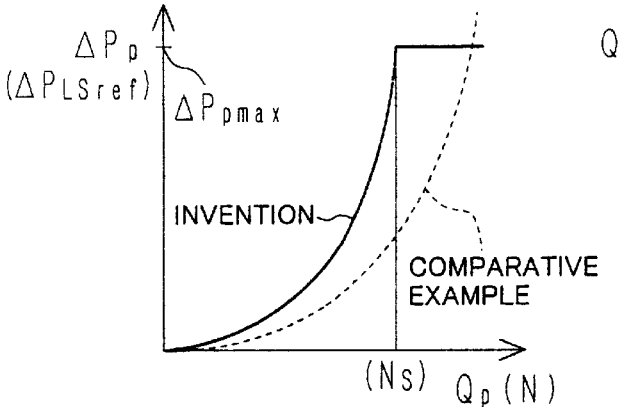
FIGS. 12A to 12C are graphs showing the operation of the flow rate detecting valve in the third embodiment.

Assuming that the setting rotational speed corresponding to the resilient force of the spring 31*c* of the flow rate detecting valve 31B is Ns, when the engine rotational speed N is lower than the setting rotational speed Ns, the flow rate detecting valve 31B is held in the left-hand position in FIG. 10 where the fixed throttle 31B*a* develops its function, as explained above, and the opening area Ap is constant. Based on the aforesaid formula (3), therefore, the differential pressure ΔPp across the flow rate detecting valve 31B increases following a curve of secondary degree with respect to the delivery rate Qp of the hydraulic pump 30 or the rotational speed N of the engine 1, as shown in FIG. 12A. It to be noted that the opening area Ap of the fixed throttle 31B*a* is set smaller than that of the fixed throttle in the comparative example and eventually an increase rate of the differential pressure ΔPp across the fixed throttle is higher than in the comparative example indicated by a dotted line.

When the engine rotational speed N exceeds the setting rotational speed Ns, the flow rate detecting valve 31B operates so as to maintain the differential pressure ΔPp across itself at the setting differential pressure specified by the spring 31*c*. The differential pressure ΔPp across the flow rate detecting valve 31B is therefore kept substantially constant at ΔPpmax, as shown in FIG. 12A.

Figure 12B:
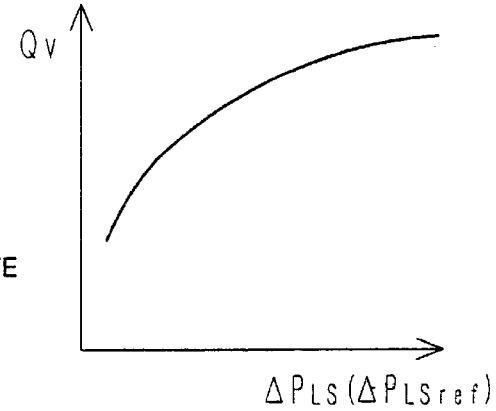

In a like manner as explained above in connection with FIG. 3C, a flow rate Qv demanded by each of the flow control valves 6*a*, 6*b*, 6*c* increases following a curve of secondary degree with respect to the target differential pressure ΔPLSref, as shown in FIG. 12B.

Figure 12C:
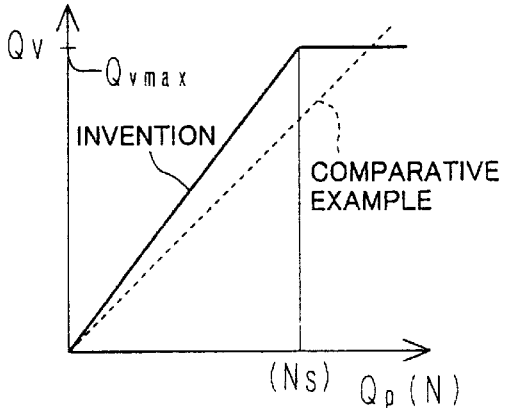

As a combined result of the characteristic of FIG. 12A and the characteristic of FIG. 12B, the demanded flow rate Qv varies with respect to the rotational speed N of the engine 1, as shown in FIG. 12C. More specifically, when the engine rotational speed N is lower than the setting rotational speed Ns, the change of ΔPp represented by a curve of secondary degree shown in FIG. 12A and the change of the demanded flow rate Qv represented by a curve of secondary degree shown in FIG. 12B cancel each other. As a result, the demanded flow rate Qv increases almost linearly with respect to the rotational speed N of the engine 1. A gradient of the linear line (change rate) is however greater than in the comparative example indicated by a dotted line. When the engine rotational speed N exceeds the setting rotational speed Ns, ΔPp in FIG. 12A is kept substantially constant at ΔPpmax and therefore the demanded flow rate Qv is also kept substantially constant correspondingly.

As stated above, when driving a plurality of, e.g., two or three, actuators, the relationship of FIG. 12C is obtained for each of the flow control valves 6*a*, 6*b* or 6*a*, 6*b*, 6*c*, and the relationship between the rotational speed N of the engine 1 and a total of respective demanded rates Qv is given as one resulted from simply adding the relationship of FIG. 12C two or three times.

Figure 13:
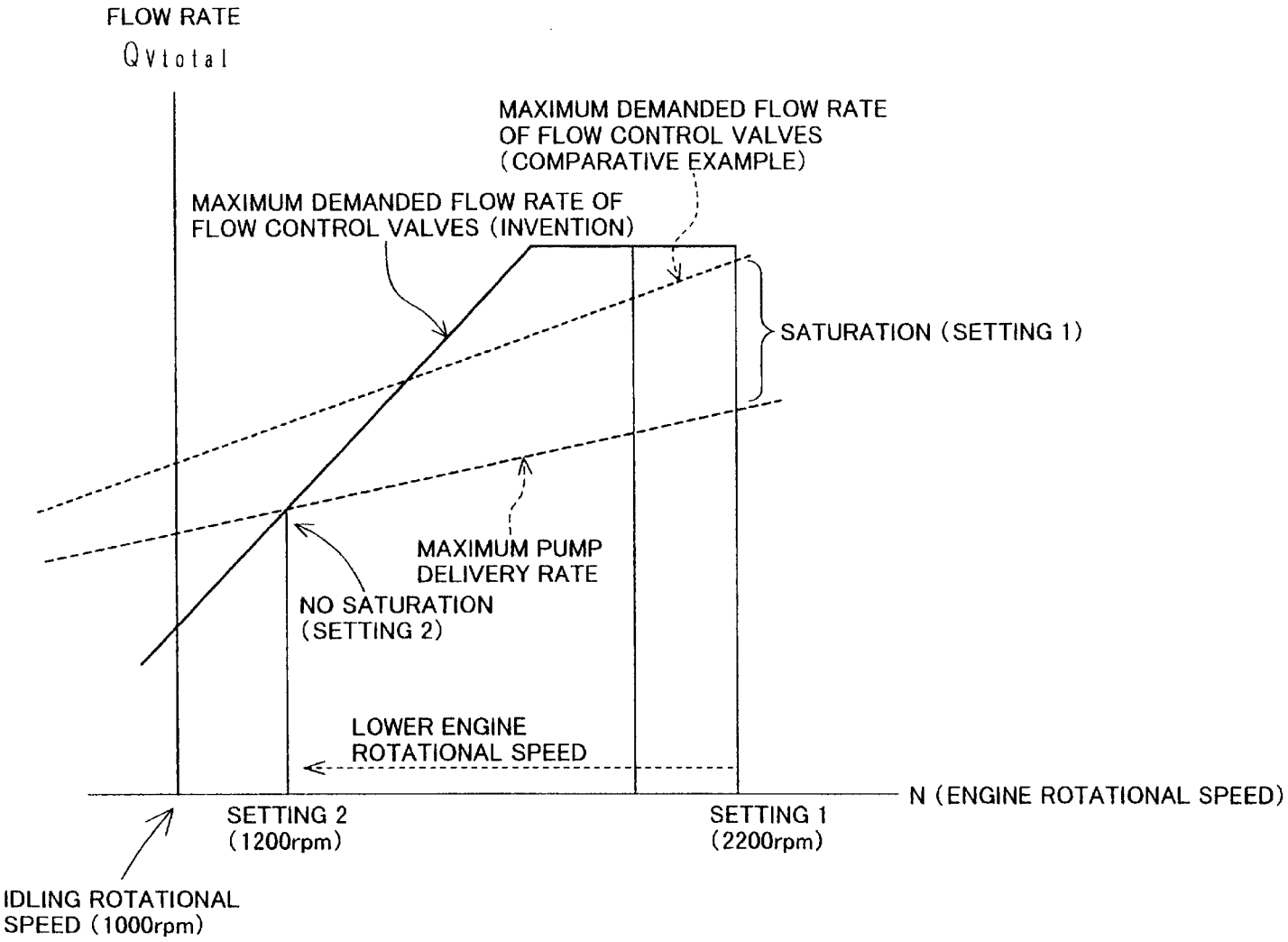
FIG. 13 is a graph showing the relationships of an engine rotational speed versus a maximum demanded flow rate of flow control valves and a maximum pump delivery rate as resulted from the provision of the flow rate detecting valve in the third embodiment.

FIG. 13 shows the relationships of the rotational speed N of the engine 1 versus a total maximum demanded flow rate Qvtotal of any two of the flow control valves 6*a*, 6*b*, 6*c*, e.g., the flow control valves 6*a*, 6*b*, (i.e., total of the flow rates Qv demanded by the flow control valves 6*a*, 6*b* at maximum opening areas thereof) and a maximum delivery rate Qsmax of the variable displacement hydraulic pump 2, the relationships being obtained based on FIG. 12C.

As seen from FIG. 13, also in this embodiment, when the engine rotational speed N is lower than the setting rotational speed Ns, the total maximum demanded flow rate Qvtotal of the flow control valves 6*a*, 6*b* is smaller than the maximum delivery rate Qsmax of the hydraulic pump 2 determined by the engine rotational speed at that time. Therefore, at setting 1 where the rotational speed N of the engine 1 is set to be suitable for carrying out ordinary work, the system is under a condition giving rise to saturation because the total maximum demanded flow rate Qvtotal of the flow control valves 6*a*, 6*b* when driving the plural actuators 3*a*, 3*b* is greater than the maximum delivery rate of the hydraulic pump 2. On the other hand, at setting 2 where the rotational speed N of the engine 1 is set to a low value, the total maximum demanded flow rate Qvtotal of the flow control valves 6*a*, 6*b* is reduced to become smaller than the maximum delivery rate of the hydraulic pump 2 and hence no saturation occurs.

Accordingly, as explained above in connection with the first embodiment by referring to FIG. 6, when the engine rotational speed is lowered, the total demanded flow rate Qvtotal of the flow control valves 6*a*, 6*b* corresponding to the total lever input amount is held lower than the maximum delivery rate Qsmax of the hydraulic pump 2 in spite of reduction in the maximum flow rate Qsmax capable of being supplied from the hydraulic pump 2 to the flow control valves. Thus a gradient of the line representing change in the flow rate passing through the flow control valves 6*a*, 6*b* is so reduced as to ensure a wide metering effective area.

Furthermore, in FIG. 13, at setting 3 where the rotational speed N of the engine 1 is set to a value slightly lower than at the ordinary setting (setting 1), the demanded flow rate Qvtotal of the flow control valves 6*a*, 6*b* is reduced a little from that at the ordinary setting (setting 1), but the amount of change is not appreciable and the total maximum demanded flow rate Qvtotal of the flow control valves 6*a*, 6*b* is held at a higher value than that resulted when providing the setting 3 in the comparative example. As explained above in connection with the first embodiment by referring to FIG. 8, however, a gradient of the line representing change in the flow rate passing through the flow control valves 6*a*, 6*b* with respect to the total lever input amount is not virtually changed from the gradient resulted at the setting 1, thus enabling the operation to be performed with good response.

As a result, this embodiment can also provide similar operating advantages as obtainable with the first embodiment in that when the engine rotational speed is set to a low value, good operability in fine operation can be achieved, and when the engine rotational speed is set to a high value, a powerful feeling can be realized in the operation with good response.

Further, this embodiment can provide a practical flow rate detecting valve because the casing 31B*f* of the flow rate detecting valve 31B has a simple cylindrical shape and hence can be manufactured very easily.

It is to be noted that while the above embodiments have been explained as detecting the engine rotational speed and modifying the target differential pressure based on the detected speed in a hydraulic manner, such a process may be performed electrically by, e.g., detecting the engine rotational speed with a sensor and calculating the target differential pressure from a sensor signal.

Additionally, while the pressure compensating valves have been described as being of the pre-stage type installed upstream of the flow control valves, the pressure compensating valves may be of the post-stage type installed downstream of the flow control valves to control respective output pressures of all the flow control valves to the same maximum load pressure, thereby controlling respective differential pressures across the flow control valves to the same differential pressure ΔPLS.

INDUSTRIAL APPLICABILITY

According to the present invention, it is possible to establish the system setting adapted for the purpose of work intended by the operator based on setting of the engine rotational speed and to realize a good feeling in the operation.

What is claimed is:

1. A hydraulic drive system comprising an engine, a variable displacement hydraulic pump driven by said engine, a plurality of actuators driven by a hydraulic fluid delivered from said hydraulic pump, a plurality of flow control valves for controlling flow rates of the hydraulic fluid supplied from said hydraulic pump to said plurality of actuators, pump displacement control means for controlling the displacement of said hydraulic pump so that a differential pressure ΔPLS between a delivery pressure Ps of said hydraulic pump and a maximum load pressure PLS among said plurality of actuators is maintained at a setting value ΔPLSref, and setting modifying means for detecting a rotational speed of said engine and modifying the setting value ΔPLSref depending on the detected rotational speed of said engine, wherein said hydraulic drive system further comprises:

a plurality of pressure compensating valves for controlling respective differential pressures across said plurality of flow control valves to the same value as said differential pressure ΔPLS, said hydraulic pump and said plurality of flow control vales having flow rate characteristics set in such a relationship that when said rotational speed of the engine is in a region including a rated rotational speed, a total maximum demanded flow rate Qvtotal of said plurality of flow control valves expressed as a function of the respective differential pressure across said plurality of flow control valves controlled by said plurality of flow control valves controlled by said plurality of pressure compensating valves and respective opening areas of said control valves, is larger than a maximum delivery rate Qsmax of said hydraulic pump at the instantaneous engine rotational speed at that time;

said setting modifying means being configured such that when the said engine rotational speed is in a region including the lowest rotational speed of said engine, the setting value ΔPLSref of said pump displacement control means is modified so that the total maximum demanded flow rate Qvtotal of said plurality of flow control valves is smaller than the maximum delivery rate Qsmax of said hydraulic pump at the instantaneous engine rotational speed at that time.

2. A hydraulic drive system comprising an engine, a variable displacement hydraulic pump driven by said engine, a plurality of actuators driven by a hydraulic fluid delivered from said hydraulic pump, a plurality of flow control valves for controlling flow rates of the hydraulic fluid supplied from said hydraulic pump to said plurality of actuators, pump displacement control means for controlling the displacement of said hydraulic pump so that a differential pressure ΔPLS between a delivery pressure Ps of said hydraulic pump and a maximum load pressure PLS among said plurality of actuators is maintained at a setting value ΔPLSref, and setting modifying means for detecting a rotational speed of said engine and modifying the setting value ΔPLSref depending on the detected rotational speed of said engine, wherein said hydraulic drive system further comprises:

a plurality of pressure compensating valves for controlling respective differential pressures across said plurality of flow control valves to the same value as said differential pressure ΔPLS, and wherein said setting modifying means comprises a fixed displacement hydraulic pump driven by said engine along with said variable displacement hydraulic pump, a flow rate detecting valve disposed in a delivery line of said fixed displacement hydraulic pump, a flow rate detecting valve disposed in a delivery line of said fixed displacement hydraulic pump, and an operation driver for modifying said setting value ΔPLSref of said pump displacement control means depending on a differential pressure ΔPp across said flow rate detecting valve, said flow rate detecting valve being constructed to have a larger opening area when the engine rotational speed is in the region including the rated rotational speed than when the engine rotational speed is in a region including the lowest rotational speed.

3. A hydraulic drive system according to claim 2, wherein said flow rate detecting valve comprises a valve apparatus including a variable throttle and throttle adjusting means for adjusting an opening area of said variable throttle to become smaller as the rotational speed of said engine lowers.

4. A hydraulic drive system according to claim 2, wherein said flow rate detecting valve comprises a valve apparatus including a fixed throttle, and throttle adjusting means for making said fixed throttle effective when the engine rotational speed is in the region including the lowest rotational speed, and controlling said fixed throttle to reduce an increase rate of the differential pressure across said flow rate detecting valve when the engine rotational speed rises to a certain setting rotational speed lower than the rated rotational speed.

5. A hydraulic drive system according to claim 3, wherein said throttle adjusting means adjusts a position of said valve apparatus depending on the differential pressure ΔPp across said flow rate detecting valve itself.

6. A hydraulic drive system according to claim 2, wherein said setting modifying means further comprises a pressure control valve for generating a signal pressure corresponding to the differential pressure ?Pp across said flow rate detecting valve, said operation driver modifying said setting value ΔPLSref in accordance with a signal pressure from said pressure control valve.

7. A hydraulic drive system according to claim 2, wherein said pump displacement control means comprises a servo piston for operating a displacement varying mechanism of said variable displacement hydraulic pump, and a tilting control unit for driving said servo piston depending on the differential pressure ΔPLS between the delivery pressure PLS of said actuators, thereby maintaining the differential pressure ΔPLS at said setting value ΔPLSref, said tilting control unit including a spring for setting a basic value of said setting value ΔPLSref, said operation driver cooperating with said spring to variably set said setting value ΔPLSref.

* * * * *